US010809644B2

(12) United States Patent
Takazawa

(10) Patent No.: US 10,809,644 B2
(45) Date of Patent: Oct. 20, 2020

(54) BELT DEVICE, IMAGE FORMING APPARATUS, AND MARK FORMING METHOD

(71) Applicant: Oki Data Corporation, Minato-ku, Tokyo (JP)

(72) Inventor: Takayuki Takazawa, Tokyo (JP)

(73) Assignee: OKI DATA CORPORATION, Tokyo (JP)

( * ) Notice: Subject to any disclaimer, the term of this patent is extended or adjusted under 35 U.S.C. 154(b) by 0 days.

(21) Appl. No.: 16/515,529

(22) Filed: Jul. 18, 2019

(65) Prior Publication Data

US 2020/0073275 A1 Mar. 5, 2020

(30) Foreign Application Priority Data

Aug. 29, 2018 (JP) ..... 2018-160635

(51) Int. Cl.
*G03G 15/043* (2006.01)
*G03G 15/00* (2006.01)
*G03G 15/16* (2006.01)

(52) U.S. Cl.
CPC ..... *G03G 15/043* (2013.01); *G03G 15/5054* (2013.01); *G03G 15/161* (2013.01)

(58) Field of Classification Search
CPC ..... G03G 15/043; G03G 15/5054; G03G 15/161; G03G 2215/0016; G03G 2215/0161
See application file for complete search history.

(56) References Cited

U.S. PATENT DOCUMENTS

2005/0238371 A1* 10/2005 Sudo ..... G03G 15/161 399/38
2016/0378036 A1* 12/2016 Onishi ..... G03G 15/5054 399/302
2018/0149998 A1 5/2018 Furukawa

FOREIGN PATENT DOCUMENTS

EP 1612613 A1 1/2006
EP 3115848 A1 1/2017
JP 2017-016076 A 1/2017

* cited by examiner

*Primary Examiner* — Sandra Brase
(74) *Attorney, Agent, or Firm* — Panitch Schwarze Belisario & Nadel LLP

(57) ABSTRACT

A belt device includes a belt, a driving roller, and driven roller. The belt is endless and includes a flat outer peripheral surface, an inner peripheral surface, and a mark part provided on the outer peripheral surface and depressed toward the inner peripheral surface. The mark part has grooves extending in the first direction. Two or more of the grooves each include a middle portion away from a border between the outer peripheral surface and the corresponding groove, and an edge portion coupling the middle portion to the border, and each have a middle-portion depth, a depth of the middle portion from the outer peripheral surface, greater than an edge-portion depth, a depth of the edge portion from the outer peripheral surface, and each have a deepest portion at a position away from the border by 0.2 millimeters or more from the border toward the middle portion.

14 Claims, 8 Drawing Sheets

| | DEPTH[μm] | | LENGTH[mm] | | | EVALUATION LEVEL |
|---|---|---|---|---|---|---|
| | Da | Db | L | La | Lb | |
| COMPARATIVE EXAMPLE 1 | 14.3 | 13.8 | 7.0 | 7.0 | ABSENT | 1 |
| COMPARATIVE EXAMPLE 2 | 13.2 | 6.5 | 7.0 | 6.8 | 0.1 | 2 |
| COMPARATIVE EXAMPLE 3 | 12.6 | 6.8 | 7.0 | 6.6 | 0.2 | 2 |
| COMPARATIVE EXAMPLE 4 | 10.3 | 9.0 | 7.0 | 7.0 | ABSENT | 3 |
| COMPARATIVE EXAMPLE 5 | 10.6 | 8.5 | 7.0 | 6.8 | 0.1 | 3 |
| WORKING EXAMPLE 1 | 11.0 | 5.5 | 7.0 | 6.6 | 0.2 | 5 |
| WORKING EXAMPLE 2 | 10.8 | 5.3 | 7.0 | 6.0 | 0.5 | 5 |
| WORKING EXAMPLE 3 | 5.6 | 2.5 | 7.0 | 6.6 | 0.2 | 5 |
| WORKING EXAMPLE 4 | 5.3 | 2.3 | 7.0 | 6.6 | 0.2 | 5 |
| WORKING EXAMPLE 5 | 2.0 | 0.8 | 7.0 | 6.6 | 0.2 | 5 |
| COMPARATIVE EXAMPLE 6 | 1.5 | 0.6 | 7.0 | 6.6 | 0.2 | 4 |
| COMPARATIVE EXAMPLE 7 | 5.3 | 1.5 | 7.0 | 1.0 | 3.0 | 4 |

FIG. 8

| EVALUATION LEVEL | PASSING-THROUGH EVALUATION | | DETECTION EVALUATION | |
|---|---|---|---|---|
| | STATE AND POSITION OF OCCURRENCE | DETERMI-NATION | DIFFERENTIAL VOLTAGE ΔV | DETERMI-NATION |
| 5 | NOT OCCURRED | GOOD | ΔV ≥ 1.0[V] | GOOD |
| 4 | NOT OCCURRED | GOOD | ΔV < 1.0[V] | POOR |
| 3 | OCCURRED IN EDGE PORTION | POOR | ΔV ≥ 1.0[V] | GOOD |
| 2 | OCCURRED IN MIDDLE PORTION | POOR | ΔV ≥ 1.0[V] | GOOD |
| 1 | OCCURRED IN ENTIRE REGION OF MARK | POOR | ΔV ≥ 1.0[V] | GOOD |

FIG. 9

| | EDGE DEPTH RATIO Db/Da | EDGE LENGTH RATIO Lb/Da |
|---|---|---|
| COMPARATIVE EXAMPLE 4 | 0.874 | 0 |
| COMPARATIVE EXAMPLE 5 | 0.802 | 0.009 |
| WORKING EXAMPLE 1 | 0.500 | 0.018 |
| WORKING EXAMPLE 2 | 0.491 | 0.046 |
| WORKING EXAMPLE 3 | 0.446 | 0.036 |
| WORKING EXAMPLE 4 | 0.434 | 0.038 |
| WORKING EXAMPLE 5 | 0.400 | 0.100 |

FIG. 10

| | LENGTH [mm] | DIFFERENTIAL VOLTAGE ΔV[V] | MARK EFFECTIVE LENGTH La | | EVALUATION LEVEL |
|---|---|---|---|---|---|
| | | | [ms] | [mm] | |
| COMPARATIVE EXAMPLE 8 | 1 | 0.7 | 0.3 | 0.1 | 1 |
| COMPARATIVE EXAMPLE 9 | 2 | 1.4 | 8.6 | 1.3 | 3 |
| COMPARATIVE EXAMPLE 10 | 3 | 1.5 | 14.7 | 2.2 | 4 |
| COMPARATIVE EXAMPLE 11 | 4 | 1.6 | 21.5 | 3.2 | 4 |
| WORKING EXAMPLE 6 | 5 | 1.6 | 28.4 | 4.3 | 5 |
| WORKING EXAMPLE 7 | 10 | 1.6 | 48.4 | 7.3 | 5 |
| WORKING EXAMPLE 8 | 15 | 1.6 | 79.1 | 11.9 | 5 |
| COMPARATIVE EXAMPLE 12 | 20 | 1.6 | 104.5 | 15.7 | 2/4 |

FIG. 11

| EVALUATION LEVEL | DIFFERENTIAL VOLTAGE ΔV | DETERMI-NATION | SIMILARITY IN EFFECTIVE LENGTH AND OCCURRENCE OF PROBLEM | DETERMI-NATION |
|---|---|---|---|---|
| 5 | ΔV ≥ 1.0[V] | GOOD | NO SIMILARITY, NO PROBLEM | GOOD |
| 4 | ΔV ≥ 1.0[V] | GOOD | SIMILAR TO EFFECTIVE LENGTH DERIVED FROM BENT CHARACTERISTIC OF BELT | POOR |
| 3 | ΔV ≥ 1.0[V] | GOOD | SIMILAR TO EFFECTIVE LENGTH DERIVED FROM DAMAGE OF BELT | POOR |
| 2 | ΔV ≥ 1.0[V] | GOOD | RUFFLING OF BELT | POOR |
| 1 | ΔV < 1.0[V] | POOR | — | — |

FIG. 12

BELT DEVICE, IMAGE FORMING APPARATUS, AND MARK FORMING METHOD

CROSS REFERENCE TO RELATED APPLICATIONS

The present application claims priority from Japanese Patent Application No. 2018-160635 filed on Aug. 29, 2018, the entire contents of which are hereby incorporated by reference.

BACKGROUND

The technology relates to a belt device, an image forming apparatus, and a mark forming method. One embodiment of the technology may be suitable for applying, for example, to an electrophotographic image forming apparatus such as a so-called printer.

Some existing image forming apparatuses generate toner images by a plurality of developing units, transfer the generated toner images onto a belt that is caused to travel by a belt device, further transfer the toner images from the belt onto a print medium conveyed by a conveying section, and fix the toner images to the print medium by heating or applying pressure, thereby printing an image. The toner images are each generated by the corresponding developing unit with the use of a toner of a corresponding color. The toner may be an example of a developer. The print medium may be, for example but not limited to, a sheet of paper.

Some image forming apparatuses have a preformed mark part at a location such as an end portion of a belt where a toner image is not to be transferred. The mark part is directed to position detection and may be hereinafter referred to as a "position detection mark". The position detection mark is detected by an optical sensor. The above-described image forming apparatus may be able, for example, to control registration of toner images of respective colors to be transferred onto the belt or to control a traveling speed of the belt, by detecting the position detection mark by the sensor.

The position detection mark may be formed, for example, by irradiating, with laser light, a portion, of the belt, where the position detection mark is to be formed. The irradiation of the laser light described above alters a surface of the belt to make optical reflectance of the irradiated portion lower than that of a portion surrounding the irradiated portion. For example, reference can be made to FIG. 5, etc. of Japanese Unexamined Patent Application Publication No. 2017-16076.

For example, in a case where the belt is irradiated with laser light having a spot size of 0.1 mm and an irradiated position is moved in a traveling direction of the belt, a linear groove having a width of 0.1 mm may be formed on the belt. For example, the linear grooves described above may be formed sequentially at respective positions shifted from each other by 0.1 mm in a width direction of the belt. The width direction of the belt may be orthogonal to the traveling direction of the belt. Thereby, for example, a position detection mark may be formed having a 7 mm square shape and having a depth of about 10 μm from the surface of the belt.

SUMMARY

According to one embodiment of the technology, there is provided a belt device that includes a belt, a driving roller, and a driven roller. The belt is endless and includes an outer peripheral surface, an inner peripheral surface, and a mark part. The outer peripheral surface is flat. The inner peripheral surface is provided opposite to the outer peripheral surface. The mark part is provided on the outer peripheral surface and depressed from the outer peripheral surface toward the inner peripheral surface. The driving roller is in contact with the inner peripheral surface. The driving roller causes the belt to travel in a first direction. The driven roller is in contact with the inner peripheral surface. The mark part has grooves that extend in the first direction. Two or more of the grooves each include a middle portion and an edge portion. The middle portion is away from a border between the outer peripheral surface and corresponding one of the two or more of the grooves. The edge portion couples the middle portion and the border to each other. The two or more of the grooves each have a middle-portion depth that is greater than an edge-portion depth. The middle-portion depth is a depth of the middle portion from the outer peripheral surface. The edge-portion depth is a depth of the edge portion from the outer peripheral surface. The two or more of the grooves each have a deepest portion at a position away from the border by 0.2 millimeters or more from the border toward the middle portion.

According to one embodiment of the technology, there is provided an image forming apparatus that includes a belt device, an image forming unit, and a sensor. The belt device includes a belt, a driving roller, and a driven roller. The belt is endless and includes an outer peripheral surface, an inner peripheral surface, and a mark part. The outer peripheral surface is flat. The inner peripheral surface is provided opposite to the outer peripheral surface. The mark part is provided on the outer peripheral surface and depressed from the outer peripheral surface toward the inner peripheral surface. The driving roller is in contact with the inner peripheral surface of the belt. The driving roller causes the belt to travel in a first direction. The driven roller is in contact with the inner peripheral surface. The mark part has grooves that extend in the first direction. Two or more of the grooves each include a middle portion and an edge portion. The middle portion is away from a border between the outer peripheral surface and corresponding one of the two or more of the grooves. The edge portion couples the middle portion and the border to each other. The two or more of the grooves each have a middle-portion depth that is greater than an edge-portion depth. The middle-portion depth is a depth of the middle portion from the outer peripheral surface. The edge-portion depth is a depth of the edge portion from the outer peripheral surface. The two or more of the grooves each have a deepest portion at a position away from the border by 0.2 millimeters or more from the border toward the middle portion. The image forming unit forms a developer image with use of a developer. The image forming unit transfers the developer image onto the belt or a print medium conveyed by the belt. The sensor irradiates the outer peripheral surface with irradiation light and detects the mark part on the basis of reflected light. The reflected light is a portion or all, of the irradiation light, that is reflected by the belt and returns to the sensor.

According to one embodiment of the technology, there is provided an image forming apparatus that includes a belt device and a sensor. The belt device causes a belt to travel in a first direction. The belt is endless and includes an outer peripheral surface, an inner peripheral surface, and a mark part. The outer peripheral surface is flat. The inner peripheral surface is provided opposite to the outer peripheral surface. The mark part is provided on the outer peripheral surface and depressed from the outer peripheral surface toward the inner peripheral surface. The belt is wound around two or more rollers. The sensor irradiates the outer peripheral surface with irradiation light and detects the mark part on the basis of reflected light. The reflected light is a portion or all, of the irradiation light, that is reflected by the belt and returns to the sensor. The mark part has grooves that each extend in the first direction. Two or more of the grooves each have a deepest portion in a middle portion. The deepest portion has a deepest depth from the outer peripheral surface. The middle portion is provided at a position away from a border between the outer peripheral surface and corresponding one of the two or more of the grooves. The middle portion is detected by the sensor as the mark part.

According to one embodiment of the technology, there is provided a mark forming method forming a mark part on an outer peripheral surface of a belt, the belt being endless and including the outer peripheral surface and an inner peripheral surface opposite to the outer peripheral surface, the mark part being depressed from the outer peripheral surface toward the inner peripheral surface. The mark forming method includes: irradiating, as first irradiation, a first irradiation region of the outer peripheral surface, the first irradiation region being provided from a first start point to a first end point, the first irradiation region extending substantially parallel to the first direction, the first irradiation region being included in a mark formation region in which the mark part is to be formed; and irradiating, as second irradiation, a second irradiation region of the outer peripheral surface, the second irradiation region being provided from a second start point to a second end point, the second start point being different from the first start point, the second end point being different from the first end point, the second irradiation region extending substantially parallel to the first direction, the second irradiation region being included in the mark formation region and partially overlapped with the first irradiation region, the first irradiation and the second irradiation providing the mark part with a middle-portion depth that is greater than an edge-portion depth, the middle-portion depth being a depth of a middle portion from the outer peripheral surface, the edge-portion depth being a depth of an edge portion from the outer peripheral surface, the middle portion being away from a border between the outer peripheral surface and the mark formation region, the edge portion being adjacent to the border.

BRIEF DESCRIPTION OF DRAWINGS

FIG. 8 is a table describing values of respective portions of the position detection mark and evaluation results in a first evaluation test.

FIG. 9 is a table describing evaluation levels in the first evaluation test.

FIG. 10 is a table describing an edge depth ratio and an edge length ratio in the first evaluation test.

FIG. 11 is a table describing values of respective portions of the position detection mark and evaluation in a second evaluation test.

FIG. 12 is a table describing evaluation levels in the second evaluation test.

DETAILED DESCRIPTION

Figure 1:
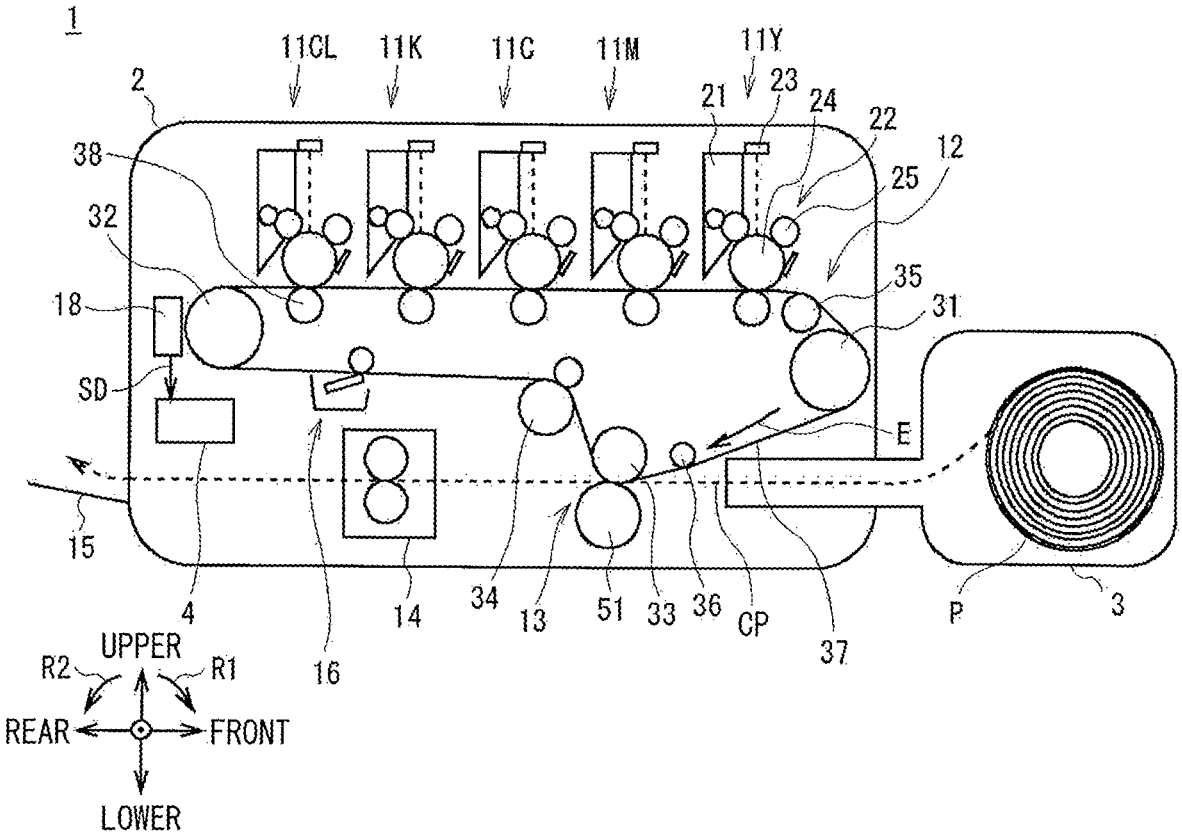
FIG. 1 is a schematic diagram illustrating an example of a configuration of an image forming apparatus according to one embodiment of the technology.

Hereinafter, some example embodiments of the technology will be described in detail with reference to the drawings. Note that the following description is directed to illustrative examples of the technology and not to be construed as limiting to the technology. Factors including, without limitation, numerical values, shapes, materials, components, positions of the components, and how the components are coupled to each other are illustrative only and not to be construed as limiting to the technology. Further, elements in the following example embodiments which are not recited in a most-generic independent claim of the technology are optional and may be provided on an as-needed basis. The drawings are schematic and are not intended to be drawn to scale. Note that the like elements are denoted with the same reference numerals, and any redundant description thereof will not be described in detail.

An image forming apparatus may include a cleaning section that cleans a surface of a belt after transferring a toner image onto a print medium such as a sheet of paper. In the cleaning section, for example, a plate member may slide against the belt in accordance with traveling of the belt while being into contact with the surface of the belt, thereby scraping off remains of a toner on the surface of the belt. The plate member may be, for example but not limited to, a resin blade.

A position detection mark may be formed in a region, of the belt, that is outside, in the width direction, a region onto which the toner image is to be transferred. Therefore, it should be difficult for the toner to get into the position detection mark in the image forming apparatus. Even if the toner gets into the position detection mark for some reasons, it should be possible to easily scrape out the toner with the blade.

However, in a case where the linear groove is provided on the belt described above, a traveling speed of the spot may be decreased at start timing and end timing of irradiation compared to that in the middle of moving the position irradiated by the laser light. Accordingly, a greater amount of heat may be generated in the vicinity of outer edge of the position detection mark, i.e., a position at which the irradiation of the laser light starts and a position at which the irradiation of the laser light ends. This may form deep depressions in local portions. The forgoing deep depression may be hereinafter referred to as a "local depression".

In a case where the toner gets into the local depression of the position detection mark of the image forming apparatus, it is difficult for the blade to scrape out the toner, and a portion of the toner may remain inside the position detection mark. In this case, it may be difficult for the sensor of the image forming apparatus to correctly detect the position detection mark. This can result in registration displacement of toner images. In a case where the print medium has a skew, an end portion of the print medium can get into a region inside the position detection mark and the toner may be attached to the end portion of the print medium. This may result in a stain or damage on the print medium. In other words, this can decrease quality of a printed material.

It is desirable to provide a belt device, an image forming apparatus, and a mark forming method that make it possible to favorably maintain a high-quality printing state.

1. Configuration of Image Forming Apparatus

Referring to FIG. 1, an image forming apparatus 1 according to an example embodiment of the technology may be an electrophotographic printer. The image forming apparatus 1 may print a desired color image on a print medium. The print medium may be, for example but not limited to, a long sheet of paper P. Roughly classifying, the image forming apparatus 1 may include a body section 2 and a print medium feeding section 3. The body section 2 may perform a printing process. The print medium feeding section 3 may feed the sheet of paper P. The image forming apparatus 1 may also include a controller 4 disposed inside the body section 2. The controller 4 may perform general control of the image forming apparatus 1.

The controller 4 may mainly include an unillustrated central processing unit (CPU). The controller 4 may read a predetermined program from a device such as an unillustrated read-only memory (ROM) or a flash memory and execute the predetermined program, thereby performing various processes related to printing. The controller 4 may further include a storage device and store various pieces of information in the storage device. The storage device may include, for example but not limited to, a random-access memory (RAM), a hard disk drive, or a flash memory.

The controller 4 may be coupled to an unillustrated host device in a wireless manner or a wired manner via an unillustrated communication processor. The host device may be, for example but not limited to, a personal computer. Upon reception of image data from the host device and reception of an instruction to print the image data from the host device, the controller 4 may start a printing process to form an image on a surface of the sheet of paper P. The image data may include an image to be printed.

For description purpose, print medium feeding section 3 side is referred to as the front, body section 2 side is referred to as the rear, foreside of the paper plane of FIG. 1 is referred to as the left, farther side of the paper plane of FIG. 1 is referred to as the right, upper side of the paper plane of FIG. 1 is referred to as upper side, and lower side of the paper plane of FIG. 1 is referred to as lower side.

The sheet of paper P as the print medium may be wound around a peripheral surface of a core member to form a roll. The core member may extend in a left-right direction. The print medium feeding section 3 may rotatably support the core member. The print medium feeding section 3 may peel off an end of the sheet of paper P from the outermost periphery of the roll of the sheet of paper P, and sequentially feed the sheet of paper P to the body section 2 which are provided on the rear side of the print medium feeding section 3.

The body section 2 may have a cuboid shape as a whole. At the upper portion inside the body section 2, five image forming units 11, i.e., image forming units 11Y, 11M, 11C, 11K, and 11CL, may be arranged in order in a direction from the front toward the rear. The image forming units 11Y, 11M, 11C, 11K, and 11CL may form toner images of the corresponding colors with the use of toners of yellow (Y), magenta (M), cyan (C), black (K), and clear (C), respectively. The clear toner may be colorless and transparent. The clear toner may be used, for example but not limited to, in a case where it is desired to provide surficial glossiness by applying the clear toner onto a toner of any other color.

Roughly classifying, the image forming unit 11 may include a toner cartridge 21, a developing unit 22, and a light-emitting diode (LED) head 23. The toner cartridge 21 may contain a toner as a developer. The toner cartridge 21 may feed the contained toner to the developing unit 22. The LED head 23 may include a plurality of LEDs linearly disposed in a left-right direction which is a first scanning direction. The LED head 23 may cause the LEDs to emit light sequentially in a light emitting pattern based on data supplied from the controller 4.

The developing unit 22 may include a photosensitive drum 24 and a plurality of rollers such as a charging roller 25 inside the developing unit 22. The developing unit 22 may apply a predetermined voltage to each of the rollers where appropriate, and may rotate each of the rollers together with the photosensitive drum 24 where appropriate. The developing unit 22 may thereby electrically charge a surface of the photosensitive drum 24 by the charging roller 25. Further, the developing unit 22 may thereby irradiate a peripheral side surface of the photosensitive drum 24 with light emitted from the LED head 23. The developing unit 22 may thereby form an electrostatic latent image on the peripheral side surface of the photosensitive drum 24.

Subsequently, the developing unit 22 may attach the toner fed from the toner cartridge 21 onto the peripheral side surface of the photosensitive drum 24, thereby forming a toner image based on the electrostatic latent image. Hereinafter, the toner image based on the electrostatic latent image may be also referred to as a developer image. The developing unit 22 may cause the toner image to reach the vicinity of a lower end of the peripheral side surface of the photosensitive drum 24 by means of rotation of the photosensitive drum 24.

On the lower side of each of the image forming units 11, a belt device 12 may be disposed. The belt device 12 may include, for example but not limited to, a driving roller 31, driven rollers 32, 33, and 34, support rollers 35 and 36, and a belt 37. The members other than the belt 37 described above, i.e., the driving roller 31, the driven rollers 32, 33, and 34, and the support rollers 35 and 36 may each have a long cylindrical shape with a central axis extending in the left-right direction. The driving roller 31, the driven rollers 32, 33, and 34, and the support rollers 35 and 36 may each be rotatably supported by the body section 2.

The driving roller 31 may be disposed on the lower-front side of the image forming unit 11Y. The driving roller 31 may rotate in a direction indicated by an arrow R1 in response to reception of drive force from an unillustrated belt drive motor. The direction indicated by the arrow R1 is a clockwise direction in FIG. 1. The driven roller 32 may be disposed on the lower-rear side of the image forming unit 11CL. The driven roller 33 may be disposed at a position located on the lower-rear side of the driving roller 31 and on the lower-front side of the driven roller 32. The driven roller 34 may be disposed at a position located on the upper-rear side of the driven roller 33 and on the lower-front side of the driven roller 32. The support roller 35 may be disposed at a position located on the upper-rear side of the driving roller 31 and in the vicinity of the driving roller 31. The support roller 36 may be disposed at a position located on the upper-front side of the driven roller 33 and in the vicinity of the driven roller 33.

The belt 37 may include, for example, a material including polyamide imide (PAI) resin added with carbon black as an electrically-charging agent. The belt 37 may be a flexible endless belt. In other words, the belt 37 may be a flexible belt having a ring shape. A length of the belt 37 in the left-right direction may be, for example, about 350 mm. Hereinafter, the left-right direction may be also referred to as a first scanning direction or a width direction.

Figure 2:
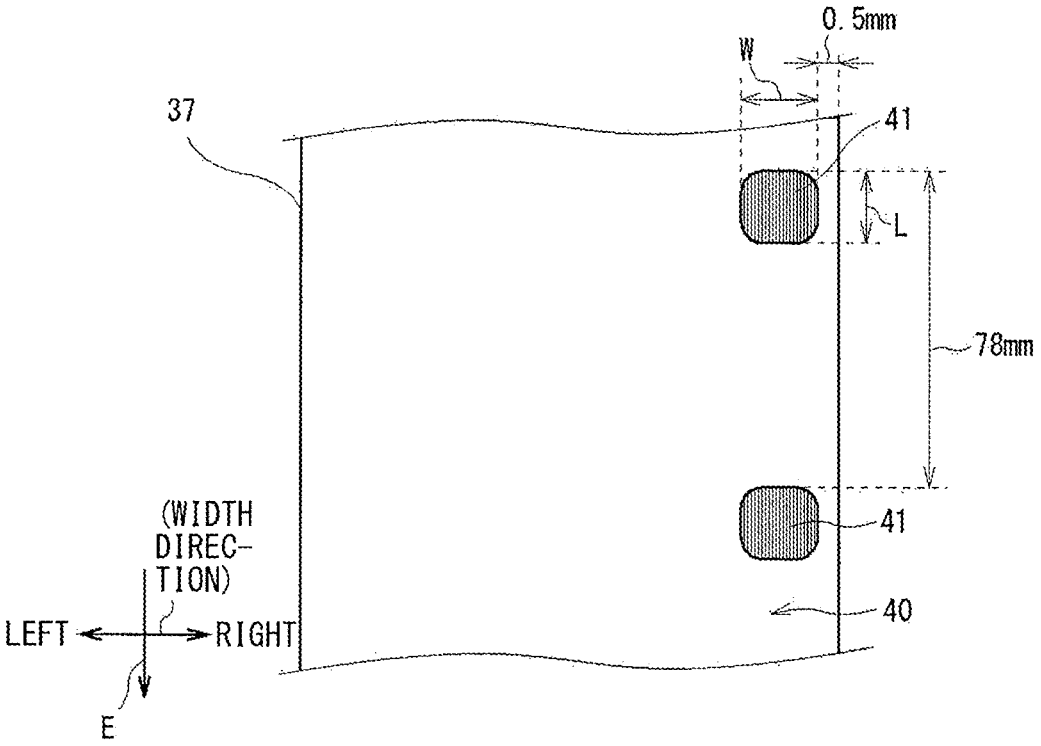
FIG. 2 is a schematic diagram illustrating an example of a configuration of a belt and an example of arrangement of position detection marks according to one embodiment of the technology.

Referring to a schematic plan view illustrated in FIG. 2, the belt 37 may be provided with two or more position detection marks 41 in the vicinity of a right end of a belt surface 40. The belt surface 40 and its vicinity of the belt 37 may be provided with a skin layer having a high material density. The belt surface 40 may be therefore relatively smooth. Accordingly, the belt 37 may allow for transferring, onto the sheet of paper P, of the toner image transferred onto the belt surface 40 while maintaining the quality of the toner image as high as possible. As the belt surface 40 is relatively smooth, the belt surface 40 may have a relatively-high light reflectance.

Further, the belt 37 may have a number of fine pores at positions located inside the belt 37 and slightly away from the belt surface 40. This makes it easier for the belt 37 itself to be deformed in accordance with a shape of a traveling path of the belt 37. The position detection mark 41 may be formed by irradiating the belt surface 40 with laser light, as will be described later. This may remove the skin layer provided on the belt surface 40 and in the vicinity of the belt surface 40 and thereby expose the pores inside the belt 37. Therefore, the surface of the position detection mark 41 may be relatively rough. In other words, the position detection mark 41 may have a light reflectance lower than that of the belt surface 40.

In some embodiments, the position detection mark 41 may have a relatively-small square shape or a relatively-small rectangle shape. In some embodiments, the position detection mark 41 may be provided at a position 0.5 mm away to the left, i.e., to inner side, from a right end of an outer surface of the belt 37. A pitch at which the position detection marks 41 are provided in the traveling direction of the belt 37 may be 78 mm. The pitch may be the same or substantially the same as a pitch at which the image forming units 11 in the body section 2 illustrated in FIG. 1 are disposed in the front-rear direction.

The belt 37 illustrated in FIG. 1 may be wound around the driving roller 31, the driven rollers 32 and 33, and the support rollers 35 and 36. In other words, the belt 37 may be wound with its inner peripheral surface in contact with the driving roller 31, the driven rollers 32 and 33, and the support rollers 35 and 36. Further, the driven roller 34 may be pressed against an outer peripheral surface of the belt 37 between the driven roller 32 and the driven roller 33. This may allow the belt 37 to lie on the upper side of the driving roller 31 and on the upper side of the driven roller 32 while being stretched between the driving roller 31 and the driven roller 32, for example.

Further, the belt device 12 may include a primary transfer roller 38 at a position located on the lower side of the belt 37 between the driving roller 31 and the driven roller 32 and below the photosensitive drum 24 of each of the image forming units 11. The primary transfer roller 38 may have a cylindrical shape that has a central axis extending in the left-right direction, as with each of the rollers of the image forming unit 11. The primary transfer roller 38 may be rotatably supported by the body section 2. The primary transfer roller 38 may receive a predetermined voltage.

The image forming unit 11 may be biased in a lower direction by an unillustrated biasing member. This may cause the photosensitive drum 24 of each of the image forming units 11 to be pressed against the primary transfer roller 38 with the belt 37 in between.

When the driving roller 31 receives drive force, the belt device 12 may rotate the driving roller 31 in the direction indicated by the arrow R1. In accordance with the rotation of the driving roller 31, the belt device 12 may cause the belt 37 to travel clockwise in the drawing while the belt 37 being wound around the members including the driving roller 31 and the driven roller 32. For description purpose, hereinafter, a direction in which the belt 37 travels may be also referred to as a belt traveling direction E.

Upon the above-described traveling of the belt 37, in a case where a toner image is formed on the peripheral side surface of the photosensitive drum 24, the image forming unit 11 may transfer the toner image from the photosensitive drum 24 onto the belt surface 40 illustrated in FIG. 2. The belt surface 40 may be the outer peripheral surface of the belt 37. The transferring of the toner image from each of the image forming units 11 onto the belt 37 while the belt 37 being traveling may cause the belt device 12 to form a color image on the outer peripheral surface of the belt 37. The foregoing color toner image may include toner images of respective colors that are superimposed on each other.

On the lower side of the belt device 12, a conveyance path CP may be formed by unillustrated members including two or more rollers and a conveyance guide. The conveyance path CP may be a path along which the sheet of paper P is conveyed in a direction from the front toward the rear. A lower end of the driven roller 33 of the belt device 12 may be in contact with the conveyance path CP. Below the driven roller 33, a secondary transfer roller 51 may be disposed. The secondary transfer roller 51 may have a cylindrical shape having a central axis extending in the left-right direction, as with the primary transfer roller 38. The secondary transfer roller 51 may be rotatably supported by the body section 2, and receive a predetermined voltage, as with the primary transfer roller 38. For description purpose, hereinafter, the secondary transfer roller 51 and the driven roller 33 may be also collectively referred to as a secondary transfer section 13.

When the portion, of the belt 37, having a transferred toner image travels from the driving roller 31 side toward the secondary transfer section 13 and the sheet of paper P is conveyed from the print medium feeding section 3 toward the rear along the conveyance path CP, the secondary transfer section 13 may transfer the toner image from the belt 37 onto the sheet of paper P and cause the sheet of paper P to continue being conveyed toward the rear along the conveyance path CP.

On the rear side of the secondary transfer section 13 may be provided a fixing section 14. The fixing section 14 may include a roller disposed on the upper side of the conveyance path CP and a roller disposed on the lower side of the conveyance path CP. One of the foregoing rollers of the fixing section 14 may include a built-in heater. The fixing section 14 may rotate each of the rollers where appropriate and heat the roller with the built-in heater by means of the heater. The fixing section 14 may thereby apply heat and pressure to the sheet of paper P conveyed along the conveyance path CP, fix the toner image to the sheet of paper P, and convey the sheet of paper P toward the rear.

Thereafter, the image forming apparatus 1 may convey the sheet of paper P toward the rear side of the fixing section 14 and discharge the sheet of paper P to the rear, onto a discharge tray 15. In the above-described manner, the image forming apparatus 1 may be able to form an image on the sheet of paper P. In other words, the image forming apparatus 1 may be able to print an image in the above-described manner.

Figure 3:
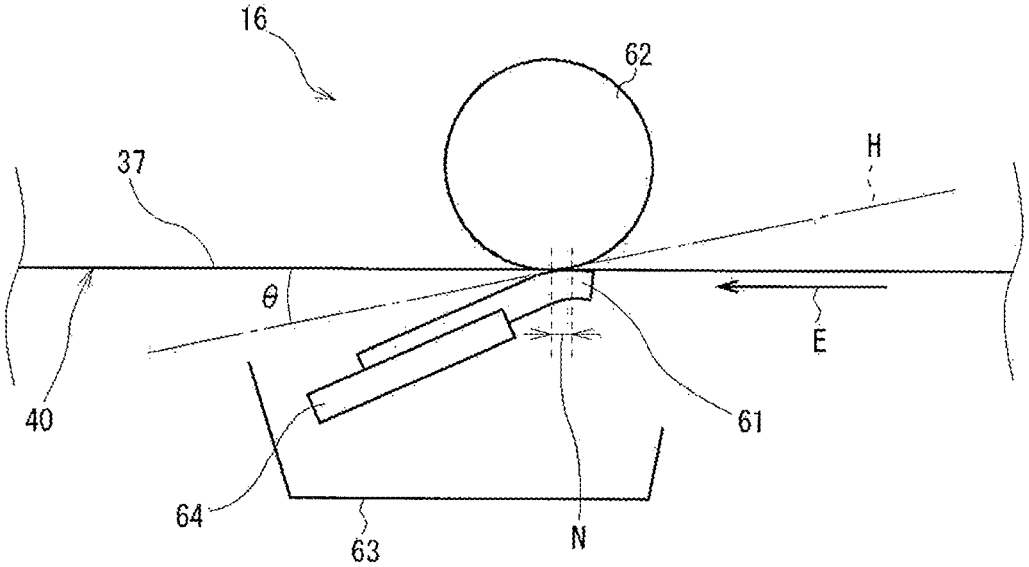
FIG. 3 is a schematic diagram illustrating an example of a configuration of a cleaning section according to one embodiment of the technology.

Between the driven roller 32 and the driven roller 34 of the belt device 12 may be provided a cleaning section 16. As illustrated in FIG. 3 in an enlarged manner, the cleaning section 16 may include a blade 61 and a roller 62. The blade 61 may be in contact with the belt surface 40 which is the outer peripheral surface of the belt 37. The roller 62 may be disposed on the upper side of the blade 61, i.e., on the opposite side of the belt 37 to the blade 61. In other words, the vicinity of an upper-front end of the blade 61 may be pressed against the outer peripheral surface of the belt 37, and the roller 62 may receive force from the blade 61 on the opposite side of the belt 37 to the blade 61 in the cleaning section 16. On the lower side of the blade 61 may be provided a cleaning box 63. The cleaning box 63 may have a shape of a box having no upper surface, i.e., a shape of a box with an opening at its upper portion.

When the belt 37 travels, the cleaning section 16 may cause the blade 61 to slide against the belt surface 40 which is the outer peripheral surface of the belt 37. In a case where the toner is attached to the belt surface 40, the cleaning section 16 may thereby be able to scrape off the attached toner and clean the belt surface 40. The toner scraped off may be contained in the cleaning box 63.

The blade 61 may be, for example but not limited to, a plate having a thickness of 2.0 mm. The blade 61 may be supported by a sufficiently-rigid supporting member 64 from the lower side of the blade 61, and fixed to the body section 2, for example. The blade 61 and the supporting member 64 may each have a length in the left-right direction, i.e., in the first scanning direction or the width direction, that is about the same as that of the belt 37. For example, the length of each of the blade 61 and the supporting member 64 may be about 350 mm.

The blade 61 may include, for example but not limited to, urethane rubber having rubber hardness of JIS (Japanese Industrial Standards) A 78°. One reason why urethane rubber is adopted as a material of the blade 61 is that urethane rubber has relatively-high hardness among rubber materials, is sufficiently elastic, and is superior in characteristics such as wear resistance, mechanical strength, oil resistance, or ozone resistance. However, the material included in the blade 61 is not limited to the urethane rubber having rubber hardness of JIS A 78°. In one example, the blade 61 may include an elastic material having rubber hardness in a range from JIS A 65° to JIS A 100° both inclusive.

In the cleaning section 16, a nip width N may be adjusted to be 0.2 mm. The nip width N may be a length of a portion, of the blade 61, that is in contact with the belt 37 in the traveling direction of the belt 37. In other words, the nip width N may be a length of the foregoing portion of the blade 61 extending approximately in the front-rear direction. A linear pressure of the blade 61 may be adjusted to be 4.3 g/mm in the cleaning section 16. In other words, the blade 61 may be substantially in linear contact with the belt 37 in the cleaning section 16. This may cause the blade 61 to be in favorable close contact with the belt 37, which enables appropriate cleaning of the belt 37 in the cleaning section 16. Further, this may prevent surface contact between the blade 61 and the belt 37 which can result in an excessive amount of frictional resistance.

A contact angle θ of the blade 61 relative to the belt 37, i.e., an angle formed by a plane along the outer surface of the belt 37 and a tangent line H at an upper-rear end of the blade 61, may be set to 21° in the cleaning section 16. However, the contact angle θ is not limited to 210. In one example embodiment, the contact angle θ may be in a range from 200 to 300 both inclusive. In another example embodiment, the contact angle θ may be in a range from 20° to 25° both inclusive.

Figure 4:
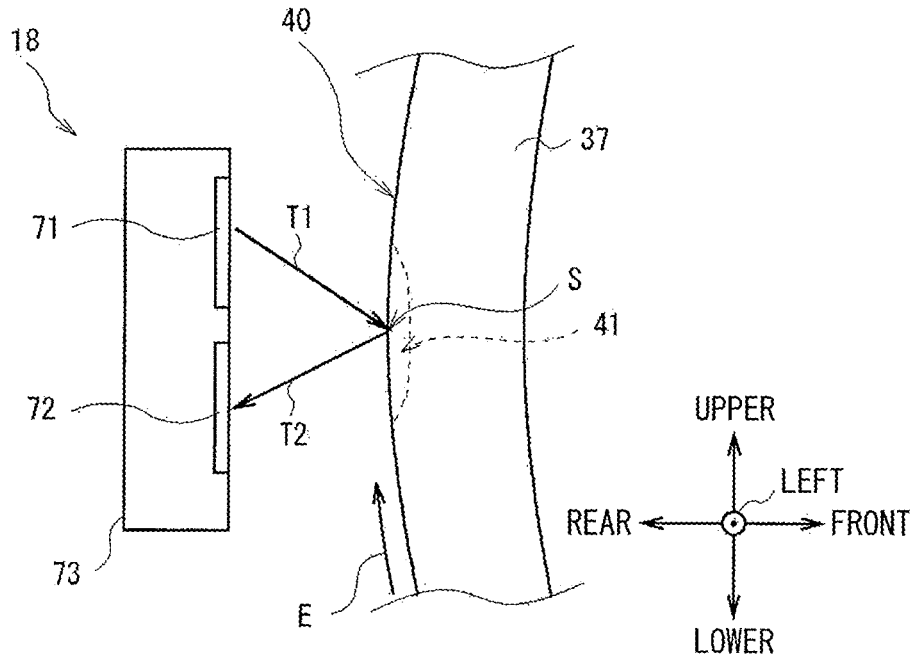
FIG. 4 is a schematic diagram illustrating an example of a configuration of a sensor according to one embodiment of the technology.

On the rear side of the driven roller 32 of the image forming apparatus 1 illustrated in FIG. 1, a sensor 18 may be disposed in the vicinity of the right end of the belt 37, i.e., at a position corresponding to the position detection mark 41 illustrated in FIG. 2. The sensor 18 may be a so-called reflective sensor. As illustrated in FIG. 4, the sensor 18 may include a light emitter 71, a light receiver 72, and a base 73. The light emitter 71 may emit light. The light receiver 72 may receive light. The base 73 may support the light emitter 71 and the light receiver 72.

The light emitter 71 may emit irradiation light T1 frontward and thereby irradiate the belt surface 40 of the belt 37 with the irradiation light T1. The irradiation light T1 may have a predetermined wavelength. The light emitter 71 may be so adjusted that a spot size a, i.e., a diameter, of the irradiation light T1 on the belt surface 40 upon the irradiation is 2 mm. For description purpose, hereinafter, a portion, of the belt 37, irradiated with the irradiation light T1 may be referred to as an irradiated portion S.

The light receiver 72 may receive reflected light T2. The reflected light T2 may be derived from the irradiation light T1 reflected by a portion such as the belt surface 40. Further, the light receiver 72 may generate a light reception signal SD having a signal level, i.e., a voltage, based on intensity of the reflected light T2, and supply the light reception signal SD to the controller 4 illustrated in FIG. 1. In response to the supply of the light reception signal SD, the controller 4 may be able to determine, on the basis of the received light reception signal SD, which of the belt surface 40 and the position detection mark 41 illustrated in FIG. 2 corresponds to the irradiated portion S. The controller 4 may measure a time interval, i.e., a period, of detection of the position detection marks 41, for example. The controller 4 may so adjust the traveling speed of the belt 37 that the measured time interval has a predetermined value. The controller 4 may thereby be able to align the position of the toner image to be transferred on the belt 37 with high accuracy.

For example, each section of the sensor 18 may be so adjusted that a voltage of the light reception signal SD generated by the light receiver 72 to be 2.7 V when the light emitter 71 irradiates the belt surface 40 with the irradiation light T1 and the light receiver 72 receives the returning reflected light T2. The voltage of the light reception signal SD generated by the light receiver 72 when the light emitter 71 irradiates the belt surface 40 with the irradiation light T1 and the light receiver 72 receives the returning reflected light T2 may be hereinafter referred to as a non-mark voltage. The above-described case may be under the assumption that the belt surface 40 is in a normal state. The normal state may be, for example but not limited to, a state where the belt surface 40 has no attachment of an extraneous substance or no damage and the belt 37 itself is not loosely wound. The non-mark voltage may be the highest of the voltages of the light reception signal SD generated by the light receiver 72.

In contrast, in the sensor 18, the voltage of the light reception signal SD generated by the light receiver 72 may be lower than the non-mark voltage in a case where the light emitter 71 irradiates the position detection mark 41 having a lower light reflectance with the irradiation light T1 and the light receiver 72 receives the returning reflected light T2.

In addition, in the sensor 18, the light reflectance of the belt surface 40 may slightly decrease, for example, in a case where the belt surface 40 of the belt 37 has attachment of an extraneous substance or has damage, compared to that in the normal state without the attachment of extraneous substance or damage. This may slightly decrease an amount of the reflected light T2 and also decrease the voltage of the light reception signal SD.

Accordingly, the controller 4 may determine that the position detection mark 41 is provided at the irradiated portion S in a case where a differential voltage ΔV between the non-mark voltage and the voltage of the light reception signal SD is equal to or greater than 1.0 V. The controller 4 may make the above-described determination under the assumption that the belt 37 travels at a speed of 6 ips (inch per second) and the sensor 18 involves an individual error. For example, in the controller 4, a reference voltage VS may be set, as a threshold, to 1.7 V which is lower than the non-mark voltage of 2.7 V by 1.0 V. On this condition, the controller 4 may determine whether the position detection mark 41 is provided at the irradiated portion S in a case where the voltage of the light reception signal SD is lower than the reference voltage VS, taking into consideration a factor such as a length of time during which the voltage of the light reception signal SD is lower than the reference voltage VS.

The controller 4 may thereby be able to differentiate variation in the light reception signal SD derived from presence of the position detection mark 41 from variation in the light reception signal SD derived from the attachment of an extraneous substance or the damage on the outer surface of the belt 37. Hence, the position detection mark 41 may be detected with high accuracy.

2. Formation of Position Detection Mark

Figure 5:
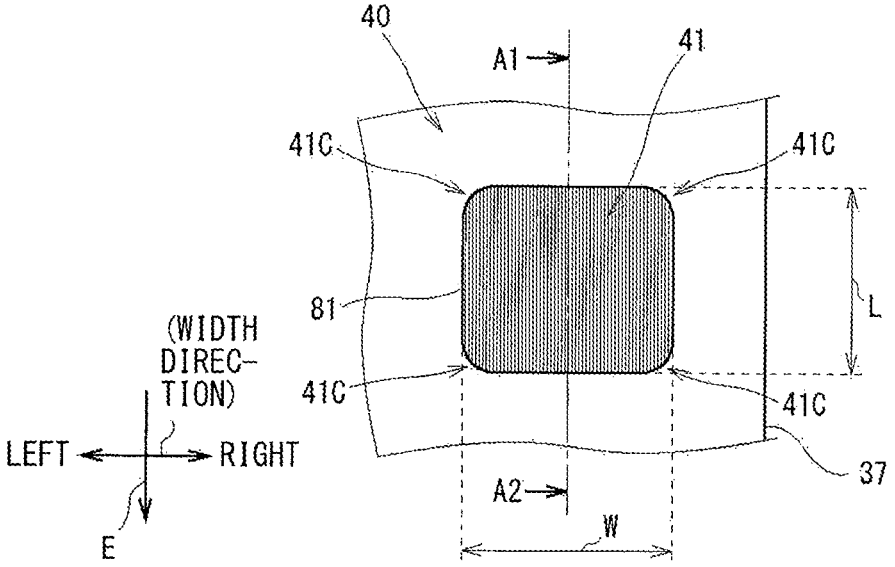
FIG. 5 is a schematic diagram illustrating an example of a configuration of the position detection mark.

A description is given next of a configuration of the position detection mark 41. As illustrated in FIG. 5 in an enlarged manner, the position detection mark 41 may have a square shape or a rectangular shape as a whole. A side, of the position detection mark 41, extending in the belt traveling direction E may have a length L. A side, of the position detection mark 41, extending in the left-right direction, i.e., the width direction, may have a length W. The belt traveling direction E may be hereinafter also referred to as a first direction.

The position detection mark 41 may be a region that is depressed compared to a portion around the position detection mark 41 and has lower light reflectance than that of the portion around the position detection mark 41. This may be a result of removing a portion of the belt surface 40 and a portion in the vicinity of the belt surface 40 by irradiating the belt surface 40 of the belt 37 with laser by means of an unillustrated predetermined laser marker apparatus.

For example, MD-V9900A available from Keyence Corporation located in Osaka, Japan, may be used as the laser marker apparatus. For example, the laser marker apparatus may irradiate the belt surface 40 with laser having a spot size of about 0.1 mm, and thereby form a depression having a shape corresponding to the spot on the belt 37. The square shape or the rectangular shape of the position detection mark 41 on the belt 37 may be provided by so disposing two or more depressions described above close to each other that the depressions are disposed in a continuous manner.

A linear depression groove having a groove width of about 0.1 mm and extending approximately parallel to the belt traveling direction E may be formed on the belt 37 by linearly moving the spot of the laser in the belt traveling direction E on the belt 37. By sequentially forming the depression grooves described above at respective positions that are shifted from each other by 0.1 mm in the left-right direction, i.e., the first scanning direction, the position detection mark 41 having a planar shape may be finally provided on the belt 37.

A depth of the depression formed on the belt 37, i.e., a distance from the belt surface 40 in a thickness direction, may be adjusted by adjusting intensity of the laser applied by the laser marker apparatus. For example, the depth of the depression from the belt surface 40 may increase as the intensity of the laser applied by the laser marker apparatus increases. In contrast, the depth of the depression from the belt surface 40 may decrease as the intensity of the laser applied by the laser marker apparatus decreases.

The position detection mark 41 on the belt 37 may have a mark corner 41C that corresponds to each vertex of the square shape or the rectangular shape of the position detection mark 41. The mark corner 41C may have a shape curved along an arc having a radius of about 0.1 mm. This avoids concentration of stress on the belt 37, thereby preventing a break of the belt 37. This also prevents the border between the belt surface 40 and the position detection mark 41 from chipping and peeling. This further prevents damage to the blade 61 accompanying the chipping or peeling of the border between the belt surface 40 and the position detection mark 41.

In a case where the belt 37 is irradiated with laser by the laser marker apparatus while linearly moving the spot in the belt traveling direction E, the moving speed of the spot may decrease in the vicinity of an irradiation start point and the vicinity of an irradiation end point, compared to that in other portions. The irradiation start point may be a point where irradiation of the belt 37 starts. The irradiation end point may be a point where the irradiation of the belt 37 ends. Accordingly, laser irradiation time may be relatively long in the vicinity of the irradiation start point and the vicinity of the irradiation end point. As a result, the vicinity of both ends of the depression groove on the belt 37 may be applied with greater amount of heat, compared to other portions of the belt 37.

Figure 6A:
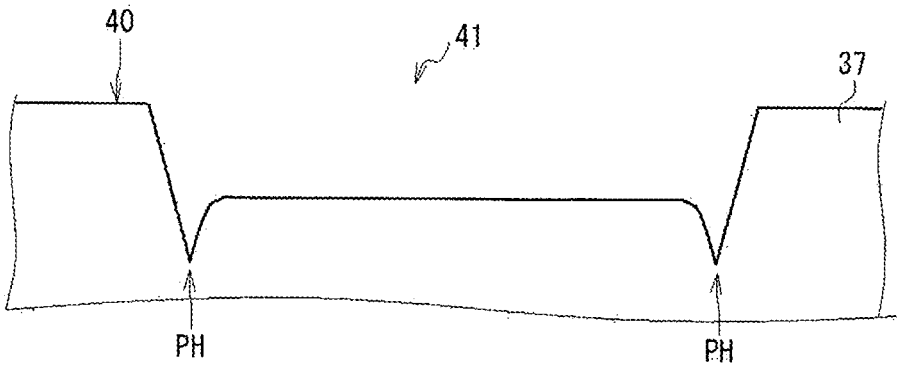
FIG. 6A is a schematic diagram illustrating an example of a cross-sectional shape of the position detection mark.

FIG. 6A illustrates a schematic cross-section of the belt 37 taken along a line A1-A2 illustrated in FIG. 5, i.e., a schematic cross-section of the belt 37 taken in the belt traveling direction E. As illustrated in FIG. 6A, the depth of the formed depression groove may be greater locally in the vicinity of both ends of the depression groove, which may provide local depressions PH. In this case, when the toner gets into the local depression PH of the position detection mark 41 formed on the belt 37, it may be difficult for the blade 61 to scrape the toner out of the local depression PH. As a result, the toner may remain inside the position detection mark 41. In this case, the accuracy of detection of the position detection mark 41 by the sensor 18 in the image forming apparatus 1 may decrease, as described above. This can result in a positional shift of the toner image or attachment of the toner to a portion such as the end of the sheet of paper P.

To address this, according to an example embodiment of the technology, in a case of forming a single depression groove as a portion of the position detection mark 41, the laser marker apparatus may perform laser irradiation twice, i.e., perform first laser irradiation and second laser irradiation. Each of the first laser irradiation and the second laser irradiation may involve linearly moving the spot of the laser with relatively-low irradiation intensity. In addition, the position of the irradiation start point may be made different between the first laser irradiation and the second laser irradiation. The position of the irradiation end point may be also made different between the first laser irradiation and the second laser irradiation.

Figure 6B:
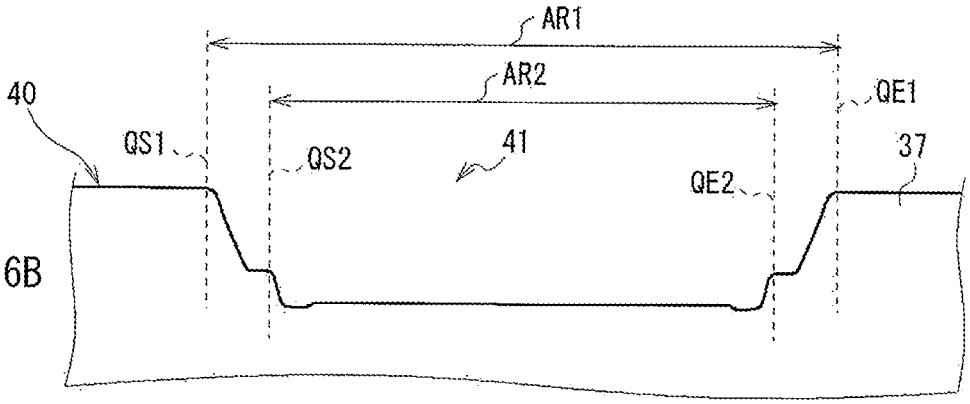
FIG. 6B is a schematic diagram illustrating an example of a cross-sectional shape of the position detection mark.

FIG. 6B illustrates a cross-section corresponding to that illustrated in FIG. 6A. As illustrated in FIG. 6B, for example, linear laser irradiation may be performed over a first irradiation region AR1 as the first laser irradiation, thereby forming a depression groove with a relatively-small depth for the position detection mark 41. The first irradiation region AR1 may be a region from a first irradiation start point QS1 to a first irradiation end point QE1. In other words, the first irradiation region AR1 may correspond to the length L illustrated in FIG. 5 that is the total length of the position detection mark 41. Thereafter, for example, linear laser irradiation may be performed again over a second irradiation region AR2 as the second laser irradiation performed on the same depression groove, thereby increasing the depth of a portion of the depression groove. The second irradiation region AR2 may be a region from a second irradiation start point QS2 to a second irradiation end point QE2. In other words, the second irradiation region AR2 may correspond to a relatively-small region around the middle of the position detection mark 41 excluding the vicinity of both ends from the region corresponding to the total length L of the position detection mark 41.

This may provide the position detection mark 41 with an inclined surface in the vicinity of each end. The inclined surface may have a depth that gradually increases in a direction from the vicinity of each end toward the middle of the position detection mark 41. A middle portion of the position detection mark 41 excluding the vicinity of both ends of the position detection mark 41 may be relatively flat and sufficiently deep.

The position detection mark 41 may be formed by providing side by side, in the width direction, i.e., in the left-right direction, two or more depression grooves each extending in the belt traveling direction E, as described above. Therefore, a border portion between the adjacent depression grooves in the position detection mark 41 may be provided with a ridge extending in the belt traveling direction E. The ridge may be, in other words, a linear collection of raised portions that are higher than the portions around.

3. Conditions of Position Detection Mark

Figure 7A:
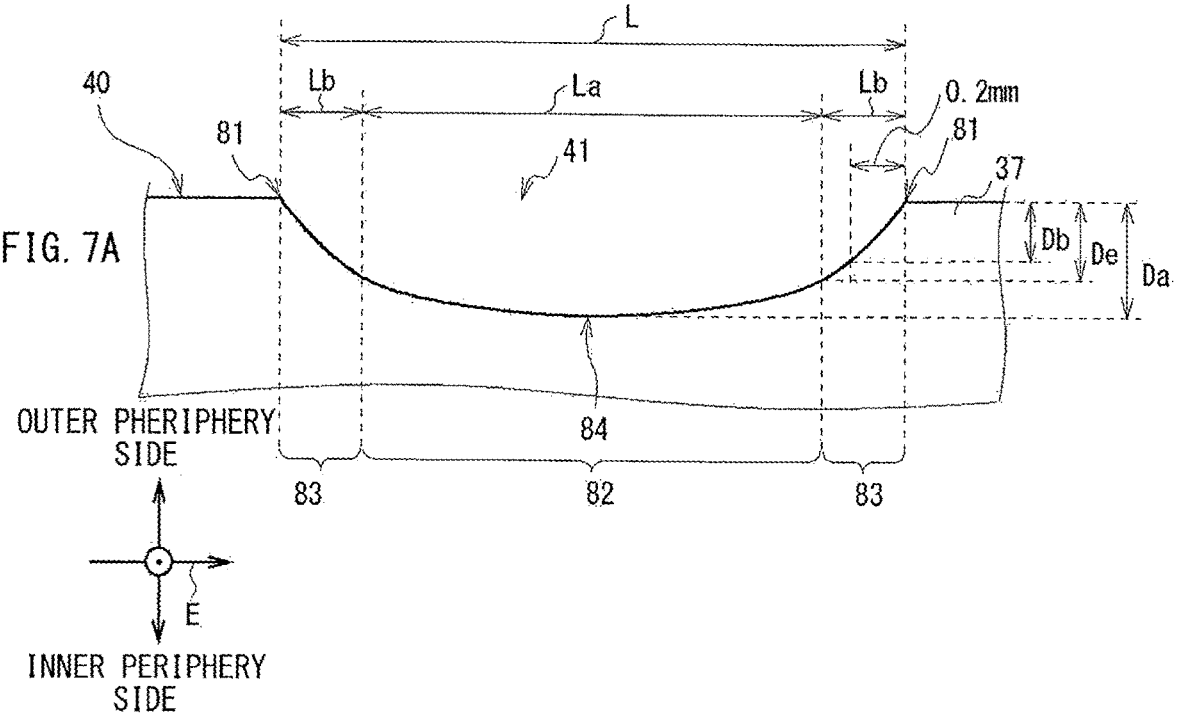
FIG. 7A is a schematic diagram illustrating an example of a length of each portion of the position detection mark and an example of a light reception signal.
Figure 7B:
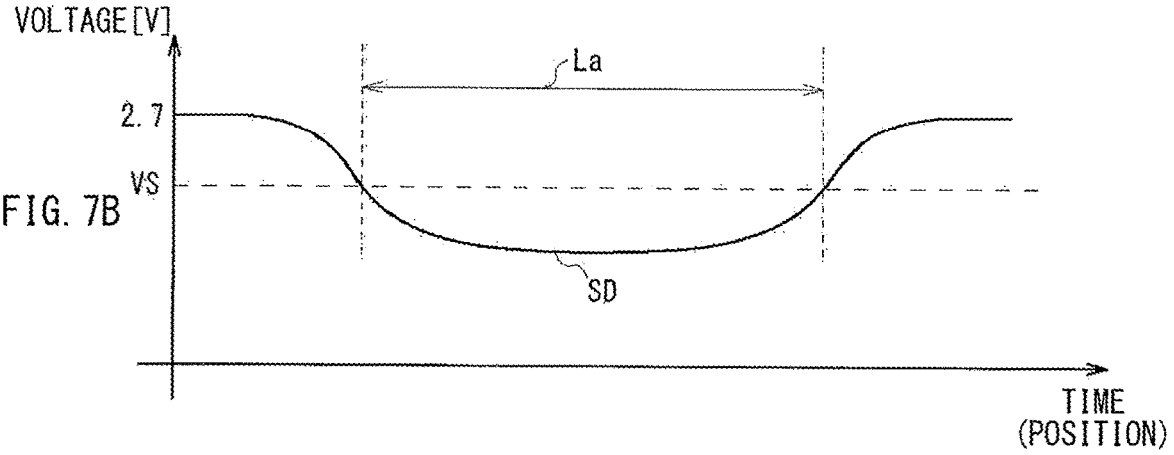
FIG. 7B is a schematic diagram illustrating an example of the light reception signal.

A description is given next of a length of each portion of the position detection mark 41 with reference to FIG. 7A. FIG. 7A illustrates the cross-sectional shape illustrated in FIG. 6B in a simpler manner. FIG. 7B is a schematic waveform chart associated with the illustration in FIG. 7A and illustrates a voltage of the light reception signal SD obtained by the sensor 18 in a case where the irradiated portion S corresponds to the position detection mark 41 on the belt 37 and a portion, of the belt surface 40, around the position detection mark 41. A horizontal axis of the waveform chart illustrated in FIG. 7B directly indicates time; however, the horizontal axis of the waveform chart illustrated in FIG. 7B may be considered as a position in the belt traveling direction E as the traveling speed of the belt 37 is constantly 6 ips.

Referring to FIG. 7A, a portion that corresponds to the border between the belt surface 40 and the position detection mark 41 and serves as an outer edge of the position detection mark 41 may be defined as an end 81. The end 81 may correspond to a line, illustrated in each of FIGS. 2 and 5, that indicates an outer frame of the position detection mark 41. In FIG. 7A, a portion between the two ends 81 in the belt traveling direction E may serve as the position detection mark 41. A distance from one end 81 to the other end 81 may correspond to the length L of the position detection mark 41. In other words, a region corresponding to the length L from one end 81 to the other end 81 may serve as a formation region of the position detection mark 41, i.e., a region in which the position detection mark 41 is to be formed.

Further, a portion corresponding to a region in which the voltage of the light reception signal SD is lower than the reference voltage VS in the waveform chart illustrated in FIG. 7B is defined as a middle portion 82 of the position detection mark 41 illustrated in FIG. 7A. Further, a portion, of the position detection mark 41, excluding the middle portion 82, i.e., a portion, of the position detection mark 41, in the vicinity of the end 81, is defined as an edge portion 83. Hereinafter, a length of the middle portion 82 in the belt traveling direction E may be referred to as a middle-portion length La, and a length of the edge portion 83 in the belt traveling direction E may be referred to as an edge-portion length Lb. As can be appreciated from FIG. 7A, in the position detection mark 41, a relationship expressed by $L=La+(Lb\times 2)$ may be established related to the lengths in the belt traveling direction E.

The middle portion 82 may correspond to a portion in which the voltage of the light reception signal SD is lower than the reference voltage VS. Therefore, the middle portion 82 may be a region that is effectively detected by the sensor 18 as a substantial region of the position detection mark 41. For this reason, hereinafter, the middle portion 82 may be also referred to as a mark effective portion or a mark effective region, and the middle-portion length La may be also referred to as a mark effective length La.

It is to be noted that the voltage of the light reception signal SD may be lower than the reference voltage VS due to decreased light reflectance not only in a case where the position detection mark 41 is formed. The voltage of the light reception signal SD may be lower than the reference voltage VS due to decreased light reflectance also in a case where the belt surface 40 has attachment of an extraneous substance or damage, for example. Therefore, hereinafter, a portion, of the light reception signal SD, in which the voltage of the light reception signal SD is lower than the reference voltage VS may be referred to as an effective portion, and a length of a portion, of the belt surface 40, corresponding to the effective portion may be referred to as an effective length, irrespective of a reason of the decrease in the voltage of the light reception signal SD.

In contrast, although the edge portion 83 may be formed together with the middle portion 82 on the belt 37 by the laser irradiation, the edge portion 83 may correspond to a region in which the voltage of the light reception signal SD is higher than the reference voltage VS. Therefore, the edge portion 83 may not be detected as the position detection mark 41 by the sensor 18.

Referring to FIG. 7A, a sufficient difference in a depth direction may be provided between the belt surface 40 and the middle portion 82 of the position detection mark 41.

Further, an inclined surface coupling the belt surface 40 and the middle portion 82 may be provided in the edge portion 83. The inclined surface may have an inclination angle that gradually decreases toward the middle portion 82 adjacent to the edge portion 83. In other words, the inclined surface may have a gradually-decreasing angle relative to the belt surface 40. In other words, a deepest portion 84 may be provided not in the edge portion 83 but in any position in the middle portion 82 of the position detection mark 41. The deepest portion 84 may be a portion having a greatest depth from the belt surface 40.

Hereinafter, the depth, from the belt surface 40, of the deepest portion 84 of the position detection mark 41 may be referred to as a maximum depth Da. A depth in the vicinity of the end 81 in the position detection mark 41 may be referred to as an outer peripheral depth Db. The depth in the vicinity of the end 81 in the position detection mark 41 may be, for example, a depth, from the belt surface 40, at a position away from the end 81 by 0.2 mm in a direction from the end 81 toward the middle of the position detection mark 41.

In a case where the toner gets into the position detection mark 41 of the belt 37 in the image forming apparatus 1, it may be necessary to scrape off or scrape out the toner by the blade 61 of the cleaning section 16, as with the toner attached to the belt surface 40. The blade 61 may include urethane rubber and may be sufficiently elastic, as described above. Therefore, the blade 61 may be able to deform in accordance with the surface of the position detection mark 41 depending on the shape of the position detection mark 41.

For example, in a case where the depth of the middle portion 82 of the position detection mark 41 is relatively small, the blade 61 may be able to elastically deform and thereby favorably scrape out the toner gotten inside the position detection mark 41. However, in a case where the depth of the middle portion 82 is sufficiently great, it may be difficult for the blade 61 to scrape out all of the toner gotten inside the position detection mark 41. As a result, the toner gotten inside the position detection mark 41 can partially remain in the position detection mark 41.

In a case where the inclination angle of the edge portion 83 of the position detection mark 41 is relatively small, i.e., in a case where the angle of the edge portion 83 relative to the belt surface 40 is relatively small, the blade 61 may be able to favorably follow the inclined surface of the edge portion 83. Therefore, the blade 61 may be able to scrape out the toner without leaving the toner inside the position detection mark 41. However, in a case where the inclination angle of the edge portion 83 is relatively great, it may be difficult for the blade 61 to follow the inclination surface of the edge portion 83 and scrape out all of the toner in the position detection mark 41. Therefore, a portion of the toner gotten inside the position detection mark 41 can remain in the position detection mark 41.

Further, the position detection mark 41 may have more than one conditions related to the length L in the belt traveling direction E. For example, in a case where the image forming apparatus 1 is turned off for a relatively-long period, a portion of the belt 37 may be kept locally bent by a member such as the driving roller 31 or the support roller 35. This may provide the belt 37 with a bent characteristic. A portion, of the belt 37, provided with the bent characteristic may diffuse, with its curved portion, the irradiation light T1 applied by the light emitter 71 of the sensor 18. This may decrease the amount of the reflected light T2 received by the light receiver 72. As a result, the signal level, i.e., the voltage, of the light reception signal SD generated by the light receiver 72 of the sensor 18 may be decreased in a portion having the bent characteristic. The portion, of the light reception signal SD, with the decreased signal level may be the effective portion. At this time, the controller 4 can erroneously recognize the portion, of the belt 37, provided with the bent characteristic as the position detection mark 41.

To address this, the mark effective length La may be set to a value different from a value of the effective length derived from the portion, of the belt 37, having the bent characteristic or may be set to an easily-differentiated value. The mark effective length La may correspond to a length in the belt traveling direction E of a portion, of the position detection mark 41 on the belt 37, to be detected by the sensor 18. In other words, the mark effective length La may correspond to a length of the middle portion 82 in the belt traveling direction E. In this case, the controller 4 of the image forming apparatus 1 illustrated in FIG. 1 may be able to determine whether the effective portion is derived from the position detection mark 41 or the portion with the bent characteristic, on the basis of the time length of the effective portion in which the signal level of the light reception signal SD is lower than the reference voltage VS illustrated in FIG. 7B, or on the basis of the length of the effective portion in the belt traveling direction E.

In a case where the length L, in the belt traveling direction E, of the position detection mark 41 on the belt 37 is sufficiently great, the belt surface 40 may be altered excessively by the laser irradiation. This can deform the belt 37 itself in the vicinity of the position detection mark 41, and a local portion of the belt 37 may be displaced toward an outer periphery thereof or toward an inner periphery thereof. In other words, so-called ruffling may occur. If the vicinity of the right end of the belt 37 where the position detection mark 41 is to be formed ruffles, the belt 37 can run on an unillustrated flange provided inside the body section 2. The flange may be directed to controlling of meandering of the belt 37. This may notably decrease mechanical resistance of the belt 37.

As described above, it may be necessary to set appropriate values that satisfy various conditions related to a length of each portion of the position detection mark 41 to be formed on the belt 37. The foregoing appropriate values may make it possible for the blade 61 of the cleaning section 16 to appropriately scrape out the toner, make it possible for the position detection mark 41 to be differentiated from the portion with the bent characteristic of the belt 37 on the basis of the light reception signal SD, and prevent the belt 37 from ruffling.

4. Evaluation of Position Detection Mark

In order to find conditions to be satisfied related to the position detection mark 41 to be formed on the belt 37, a first evaluation test and a second evaluation test were conducted. In the first evaluation test, a value related to a depth was mainly varied. In the second evaluation test, a value related to a length in the belt traveling direction E was mainly varied.

[4-1. First Evaluation Test]

As described in FIG. 8, in the first evaluation test, various shapes of position detection marks 41 were formed as working examples and comparative examples. In the first evaluation test, each of the length L of the position detection mark 41 in the belt traveling direction E and the length W of the position detection mark 41 in the width direction, i.e., the left-right direction, was fixed to 7.0 mm. A value of each of the maximum depth Da, the outer peripheral depth Db, and the edge-portion length Lb was varied. The maximum depth Da and the outer peripheral depth Db described in FIG. 8 were measured with the use of a laser microscope VK8500 available from Keyence Corporation located in Osaka, Japan.

In a case of forming the above-described position detection marks 41, specifically, a shape of each portion was varied by adjusting laser intensity of the laser marker apparatus described above. In a case where a depression groove is formed with uniform laser intensity, the moving speed of the spot may decrease in the vicinity of the irradiation start point and the vicinity of the irradiation end point as described above. This may increase the irradiation time, which results in formation of a local depression having a great depth. The position detection mark 41 of Comparative example 1 was formed by this method.

In the working examples and the comparative examples other than Comparative example 1, the laser intensity was locally decreased when the vicinity of the irradiation start point and the vicinity of the irradiation end point of the depression groove were irradiated with the laser, thereby preventing formation of the local depression having a great depth. On this condition, as described above with reference to FIG. 6B, irradiation with relatively-low-intensity laser was performed twice, i.e., the first laser irradiation and the second laser irradiation were performed, in the working examples and the comparative examples other than Comparative example 1. Further, the position of each of the irradiation start point and the irradiation end point was made different between the first laser irradiation and the second laser irradiation in the working examples and the comparative examples other than Comparative example 1. Further, in the working examples and the comparative examples other than Comparative example 1, a factor such as time or a position related to decreasing of the irradiation intensity of the laser was varied in the vicinity of the irradiation start point and the vicinity of the irradiation end point in the depression groove, thereby varying the shape of the position detection mark 41.

On the above-described conditions, each of the working examples and the comparative examples was evaluated in the first evaluation test as described in FIG. 9. Upon the evaluation, two points were checked. The first point was whether the blade 61 of the cleaning section 16 was able to scrape out the toner gotten inside the position detection mark 41. The second point was whether the sensor 18 was able to detect the position detection mark 41.

Regarding the first point described above related to whether the blade 61 is able to scrape out the toner inside the position detection mark 41, whether "passing-through" occurred was evaluated. The passing-through refers to remaining of the toner in the position detection mark 41 after the blade 61 slid against the belt 37 once. In a case where the passing-through occurred, a position at which the passing-through occurred was evaluated. Hereinafter, the evaluation described above may be also referred to as passing-through evaluation. Upon the passing-through evaluation, a case where no passing-through occurred was determined as "good", and a case where the passing-through occurred was determined as "poor".

Regarding the second point described above related to whether the sensor 18 was able to detect the position detection mark 41, whether the voltage of the light reception signal SD generated by the light receiver 72 was decreased to be equal to or lower than the reference voltage VS was evaluated. In other words, whether the differential voltage ΔV between the voltage of the light reception signal SD and the reference voltage VS was equal to or greater than 1.0 V was evaluated. Hereinafter, the evaluation described above may be also referred to as detection evaluation. Upon the detection evaluation, a case where the differential voltage ΔV was equal to or greater than 1.0 V was determined as "good", and a case where the differential voltage ΔV was smaller than 1.0 V was determined as "poor".

Further, in the first evaluation test, a result of the determination related to the passing-through evaluation and a result of the determination related to the detection evaluation were combined to make comprehensive evaluation by five levels, i.e., from evaluation level 1 to evaluation level 5.

Specifically, a case where the passing-through occurred in all of the region of the position detection mark 41 and the differential voltage ΔV was equal to or greater than 1.0 V was determined as "evaluation level 1". A case where the passing-through occurred only in the middle portion 82 and the differential voltage ΔV was equal to or greater than 1.0 V was determined as "evaluation level 2". A case where the passing-through occurred only in the edge portion 83 and the differential voltage ΔV was equal to or greater than 1.0 V was determined as "evaluation level 3". A case where no passing-through occurred but the differential voltage ΔV was smaller than 1.0 V was determined as "evaluation level 4". A case where no passing-through occurred and the differential voltage ΔV was equal to or greater than 1.0 V, i.e., a case where no problem was found in both of the passing-through evaluation and the detection evaluation, was determined as "evaluation level 5". It is to be noted that the formed position detection marks 41 having the evaluation level 5 were classified as working examples, and the formed position detection marks 41 other than those having the evaluation level 5 were classified as comparative examples in the first evaluation test.

In the first evaluation test, although specific values are not described in FIG. 8, there was a general tendency that the value of the differential voltage ΔV was proportional to the value of the maximum depth Da. In particular, as can be appreciated from comparison between Comparative example 6 and other comparative examples and the working examples, in a case where the maximum depth Da was equal to or greater than 2.0 μm, the differential voltage ΔV was equal to or greater than 1.0 V, and the sensor 18 was able to normally detect the position detection mark 41.

As described above, the belt surface 40 and the skin layer near the belt surface 40 are sufficiently removed by the laser irradiation in the position detection mark 41. This exposes the pores inside the belt 37 and thereby provides a rough surface. The rough surface provides a decreased light reflectance in the position detection mark 41. The decreased light reflectance results in a sufficient decrease in voltage of the light reception signal SD. This makes it possible for the sensor 18 to detect the position detection mark 41. In Comparative example 6, the relatively-small maximum depth Da prevented the skin layer from being removed sufficiently. Therefore, the light reflectance on the surface was kept relatively high. This seemed to result in an insufficient decrease in voltage of the light reception signal SD.

In Comparative example 7, the maximum depth Da was 5.3 μm, which was greater than 2.0 μm. However, the length La of the middle portion 82 was extremely small as 1.0 mm, which was, in particular, smaller than the spot size a (2 mm) of the irradiation light T1. Therefore, the differential voltage ΔV was smaller than 1.0 V. This was determined as "poor" in the detection evaluation. The length La of the middle portion 82 was evaluated in detail in the second evaluation test which will be described later.

In contrast, in a case where the maximum depth Da was relatively great as in Comparative examples 1 to 3, the differential voltage ΔV was equal to or greater than 1.0 V. This case involved no problem regarding the detection evaluation. However, the blade 61 did not scrape out the toner sufficiently. In other words, cleaning was not performed normally, which resulted in occurrence of the passing-through. In Comparative examples 1 to 3, the maximum depth Da was sufficiently greater than the particle size of the toner which was, for example, about 5 μm to about 7 μm. Therefore, the particles of the toner might be embedded in the position detection mark 41. This might make it sufficient for the blade 61 to follow the inside of the position detection mark 41 by means of elastic deformation. As a result, it seems that it was not possible to sufficiently scrape out the toner by single sliding of the blade 61 against the position detection mark 41.

In a case where the maximum depth Da was about the middle, for example, 10.6 μm, and the edge-portion length Lb of the edge portion 83 was sufficiently small as 0.1 mm, or the edge portion 83 was not provided substantially, as in Comparative examples 4 and 5, the passing-through did not occur in the middle portion 82 but occurred in the edge portion 83, i.e., in the vicinity of the end 81. In Comparative examples 4 and 5, the edge portion 83 of the position detection mark 41 had a sharp inclination angle, which made it difficult for the blade 61 sliding against the belt 37 to follow the surface of the edge portion 83. As a result, it seems that it was not possible to scrape out the toner.

In contrast, in a case where the maximum depth Da was 11.0 μm and the edge-portion length Lb of the edge portion 83 was 0.2 mm as in Working example 1, no passing-through occurred in the edge portion 83, and the determination related to the passing-through evaluation was "good". In Working example 1, the blade 61 of the cleaning section 16 illustrated in FIG. 3 had a nip width N of 0.2 mm. It seems that this made it easier for the blade 61 to follow the inclined surface of the edge portion 83. Working examples 2 to 5 were also determined as "good" related to both of the detection evaluation and the passing-through evaluation, which resulted in evaluation level 5.

Presuming on the basis of the working examples and the comparative examples described above, it is considered whether the passing-through occurs in the edge portion 83 of the position detection mark 41 depends on the inclination angle of the edge portion 83.

A value resulting from dividing the outer peripheral depth Db of the position detection mark 41 by the maximum depth Da of the position detection mark 41 is defined as an edge depth ratio Db/Da. The edge depth ratio Db/Da is a ratio of depth between two positions in the position detection mark 41 that are away from each other in the belt traveling direction E. Accordingly, the edge depth ratio Db/Da is able to serve as a value indicating an approximate magnitude of the inclination angle at a position that is away from the end 81 of the position detection mark 41 toward the inner side of the position detection mark 41 by 0.2 mm, i.e., of the edge portion 83 or the vicinity of the edge portion 83.

As described in FIG. 10, the edge depth ratio Db/Da was within a range from about 0.4 to about 0.5 in Working examples 1 to 5 in which no passing-through occurred. Further, if the value of the edge depth ratio Db/Da is smaller than 0.4 and the inclination angle of the edge portion 83 or the vicinity of the edge portion 83 is smaller than that in Working examples 1 to 5, it is presumable that the blade 61 is able to more favorably scrape off the toner in the edge portion 83. In contrast, in Comparative examples 4 and 5 in which the passing-through occurred in the edge portion 83, the edge depth ratio Db/Da was within a range from about 0.8 to about 0.9. On the basis of the above-described matters, it is highly possible that the passing-through does not occur in the edge portion 83 of the position detection mark 41 on a condition that at least the edge depth ratio Db/Da is equal to or smaller than 0.5, i.e., the outer peripheral depth Db is equal to or smaller than half of the maximum depth Da, and in particular, the edge depth ratio Db/Da falls within a range from 0.4 to 0.5.

A value resulting from dividing the edge-portion length Lb of the position detection mark 41 by the maximum depth Da of the position detection mark 41 is defined as an edge length ratio Lb/Da. The value of the maximum depth Da may be associated in some extent with a value of a depth De of a border portion between the middle portion 82 and the edge portion 83 of the position detection mark 41. The depth De is illustrated in FIG. 7A. Therefore, the edge length ratio Lb/Da may have a value similar to a value of a cotangent of the inclination angle of the edge portion 83.

In Working examples 1 to 5 in which no passing-through occurred, the edge length ratio Lb/Da fell within a range from about 0.018 to about 0.100. Further, if the value of the edge length ratio Lb/Da is greater than 0.100 and the inclination angle of the edge portion 83 or the vicinity of the edge portion 83 is smaller than that in Working examples 1 to 5, it is presumable that the blade 61 is able to more favorably scrape off the toner in the edge portion 83. In contrast, in Comparative examples 4 and 5 in which the passing-through occurred in the edge portion 83, the edge length ratio Lb/Da fell within a range from 0 to 0.009. On the basis of the above, it is considered that the passing-through does not occur in the edge portion 83 of the position detection mark 41 on a condition that at least the edge length ratio Lb/Da is equal to or greater than 0.018, and in particular, the edge length ratio Lb/Da falls within a range from 0.018 to 0.100.

The followings are a summary of conditions related to the depth of the position detection mark 41 based on the above-described results of the first evaluation test.

(1-1) The maximum depth Da is equal to or greater than 2.0 μm and equal to or smaller than 11.0 μm.

(1-2) The edge depth ratio Db/Da is equal to or smaller than 0.5. The edge depth ratio Db/Da may fall within a range from 0.4 to 0.5 both inclusive in one example embodiment.

(1-3) The edge length ratio Lb/Da is equal to or greater than 0.018. The edge length ratio Lb/Da may fall within a range from 0.018 to 0.100 both inclusive in one example embodiment.

[4-2. Second Evaluation Test]

As described in FIG. 11, in the second evaluation test, various shapes of position detection marks 41 were formed as working examples and comparative examples. In the second evaluation test, the length L in the belt traveling direction E was varied in a range from 1 mm to 20 mm both inclusive to form the various shapes of the position detection marks 41. The length W of the position detection mark 41 in the width direction, i.e., the left-right direction, was fixed to 7.0 mm, and the maximum depth Da fell within a range from 5 μm to 8 μm both inclusive.

In the second evaluation test, the sensor 18 irradiated the position detection mark 41 with the irradiation light T1 and received the reflected light T2 while the belt 37 was caused to travel at the traveling speed of 6 ips. The light reception signal SD having the voltage based on the amount of the received reflected light T2 was generated. Thereafter, in the second evaluation test, the differential voltage ΔV was measured that was a difference between the generated light reception signal SD and the reference voltage VS. Further, the middle-portion length La, i.e., the mark effective length La, was calculated while regarding, as the middle portion 82 of the position detection mark 41, a portion having the differential voltage ΔV of 1.0 V or greater, i.e., the effective portion. The mark effective length La may be easily calculated by multiplying the time length of the effective portion by the traveling speed of the belt 37.

In the second evaluation test, in a case where the depression groove was formed in the belt traveling direction E to thereby form the position detection mark 41, the irradiation intensity of the laser was not adjusted. Thereby, the local depression PH illustrated in FIG. 6A was formed and the edge portion 83 was prevented from being formed. An influence of the edge portion 83 on the waveform of the light reception signal SD was thereby removed as much as possible in the second evaluation test.

On the above-described conditions, each of the working examples and the comparative examples was evaluated in the second evaluation test as with the detection evaluation in the first evaluation test. Upon the evaluation in the second evaluation test, whether it was possible to appropriately detect the position detection mark 41 on the basis of the light reception signal SD generated by the sensor 18 was checked.

Specifically, whether the voltage of the light reception signal SD generated by the light receiver 72 was decreased to be equal to or lower than the reference voltage VS was evaluated. In other words, whether the differential voltage ΔV between the voltage of the light reception signal SD and the reference voltage VS was equal to or greater than 1.0 V was evaluated. That is, evaluation corresponding to the detection evaluation in the first evaluation test was made. Upon the second evaluation test, a case where the differential voltage ΔV was equal to or greater than 1.0 V was determined as "good", and a case where the differential voltage ΔV was smaller than 1.0 V was determined as "poor", basically as with the first evaluation test.

In addition, evaluation was also made related to the mark effective length La of a portion, of the light reception signal SD, derived from the position detection mark 41 in the second evaluation test. Specifically, a case where the mark effective length La was similar to the effective length of the effective portion, of the light reception signal SD, derived from any factor other than the position detection mark 41, and a case where the traveling of the belt 37 could have a concern due to the magnitude of the mark effective length La were determined as "poor". A case without the possibility of the foregoing concerns was determined as "good".

On the above-described conditions, in the second evaluation test, comprehensive evaluation was made by five levels, i.e., from evaluation level 1 to evaluation level 5, as with the first evaluation test, on the basis of the results of the determination described above.

Specifically, a case where the differential voltage ΔV was smaller than 1.0 V and the position detection mark 41 was not detectable was determined as "evaluation level 1". A case where the differential voltage ΔV was equal to or greater than 1.0 V but the belt 37 ruffled was determined as "evaluation level 2". A case where the differential voltage ΔV was equal to or greater than 1.0 V but the mark effective length La derived from the position detection mark 41 was similar to the effective length derived from a damage on the belt surface 40 was determined as "evaluation level 3". A case where the differential voltage ΔV was equal to or greater than 1.0 V but the mark effective length La was similar to the effective length derived from the portion, of the belt 37, having the bent characteristic was determined as "evaluation level 4". A case where the differential voltage ΔV was equal to or greater than 1.0 V and the mark effective length La derived from the position detection mark 41 was not similar to the effective length derived from other factors was determined as "evaluation level 5". It is to be noted that the formed position detection marks 41 having the evaluation level 5 were classified as working examples, and the formed position detection marks 41 other than those having the evaluation level 5 were classified as comparative examples, as with the first evaluation test.

The second evaluation test presented a general tendency that, in a case where the length L of the position detection mark 41 was equal to or greater than 2 mm, the effective portion having the differential voltage ΔV was formed in the light reception signal SD, which at least allowed determination of presence or absence of the position detection mark 41. In contrast, in Comparative example 8 having the length L of 1 mm, the differential voltage ΔV was 0.7 V which was smaller than 1.0 V. Therefore, an effective potential difference was not obtained for the voltage, i.e., the non-mark voltage, of the light reception signal SD obtained on the belt surface 40.

It is considered that this was resulting from that the spot size a of the irradiation light T1 applied by the light emitter 71 of the sensor 18 was 2 mm. That is, in Comparative example 8, the length L of the position detection mark 41 was smaller than the spot size a. Therefore, a portion of the irradiation light T1 was applied to the position detection mark 41 and was reflected with a low reflectance; however, the rest of the irradiation light T1 was applied to a portion, of the belt surface 40, around and outside of the position detection mark 41 and was reflected with a high reflectance. It is presumable that this made the amount of the reflected light T2 returning to the light receiver 72 of the sensor 18 relatively great, and made the voltage of the light reception signal SD relatively high as a result. It is considered that this reason may be similarly applicable to Comparative example 7 in the first evaluation test described above in which the differential voltage ΔV was smaller than 1.0 V.

In Comparative example 9, the length L was 2 mm which was substantially the same as the spot size a, and the differential voltage ΔV was equal to or greater than 1.0 V. Therefore, presence or absence of the position detection mark 41 was determinable. However, the mark effective length La in Comparative example 9 was 1.3 mm. This value was similar to the effective length of the effective portion which was to be formed in the light reception signal SD as a result of a damage on the belt surface 40. The damage on the belt surface 40 could be made, for example, by contact of the belt surface 40 with the end of the sheet of paper P.

In Comparative example 10, the length L was 3 mm, and the mark effective length La was 2.2 mm. The mark effective length La of 2.2 mm was similar to the effective length of the effective portion which was to be formed in the light reception signal SD as a result of a portion, of the belt 37, having the bent characteristic. The belt 37 could have the portion having the bent characteristic at a position where the support roller 36 illustrated in FIG. 1 was provided in a case where the belt 37 was stopped for a long time.

In Comparative example 11, the length L was 4 mm, and the mark effective length La was 3.2 mm. The mark effective length La of 3.2 mm was similar to the effective length of the effective portion which was to be formed in the light reception signal SD as a result of a portion, of the belt 37, having the bent characteristic. The belt 37 could have the portion having the bent characteristic at a position where the support roller 35 illustrated in FIG. 1 was provided in a case where the belt 37 was stopped for a long time.

In Comparative example 12, the length L was 20 mm, and the mark effective length La was 15.7 mm. The mark effective length La of 15.7 mm was similar to the effective length of the effective portion which was to be formed in the light reception signal SD as a result of a portion, of the belt 37, having the bent characteristic. The belt 37 could have the portion having the bent characteristic at a position where the driving roller 31 illustrated in FIG. 1 was provided in a case where the belt 37 was stopped for a long time.

On the basis of Comparative examples 9 to 12, upon selecting the length L of the position detection mark 41, 2 mm, 3 mm, 4 mm, and 20 mm may be so excluded in one example embodiment that the mark effective length La is prevented from being similar to the effective length of the effective portion formed in the light reception signal SD as a result of other reasons.

In addition, in Comparative example 12, an amount of alternation of the belt 37 resulting from the laser irradiation directed to formation of the position detection mark 41 was sufficiently great. Therefore, a portion, of the belt 37, around the position detection mark 41 was deformed and ruffled. It is considered that the belt 37 may ruffle also in a case where the length L of the position detection mark 41 is equal to or greater than 20 mm.

In contrast, in Working examples 6, 7, and 8, which respectively had the length L of 5 mm, 10 mm, and 15 mm, the differential voltage ΔV was equal to or greater than 1.0 V. Further, Working examples 6, 7, and 8 respectively had the mark effective length La of 4.3 mm, 7.3 mm, and 11.9 mm. These values of the mark effective length La were sufficiently different from the effective lengths of various effective portions to be formed in the light reception signal SD as a result of other reasons, and were therefore able to be differentiated from the forgoing effective lengths.

The followings are a summary of conditions related to the length L of the position detection mark 41 based on the above-described results of the second evaluation test.

(2-1) The length L is equal to or greater than the spot size a of the irradiation light T1.

(2-2) The length L is equal to or greater than 5 mm and equal to or smaller than 15 mm.

5. Example Effects, Etc.

The image forming apparatus 1 according to an example embodiment having the above-described configuration may irradiate the belt 37 with the laser by the laser marker apparatus, and thereby alter a portion of the belt surface 40, thereby forming the position detection mark 41. Further, in the example embodiment, two or more depression grooves each extending in the belt traveling direction E may be provided side by side in the width direction, thereby forming the position detection mark 41 having the rectangular shape or the square shape, as illustrated in FIGS. 2 and 5.

In addition, according to the example embodiment, upon forming each of the depression grooves of the position detection mark 41, the operation of performing laser irradiation with relatively-low intensity while linearly moving the spot may be performed twice. Further, the irradiation start point may be different between the first laser irradiation and the second laser irradiation, as illustrated in FIG. 6B. The irradiation end point may be also different between the first laser irradiation and the second laser irradiation, as illustrated in FIG. 6B.

The length of each portion of the position detection mark 41 may be set on the following depth conditions based on the results of the first evaluation test: the maximum depth Da may be equal to or greater than 2.0 μm and equal to or smaller than 11.0 μm, the edge depth ratio Db/Da may fall within a range from 0.4 to 0.5, and the edge length ratio Lb/Da may fall within a range from 0.018 to 0.100, as illustrated in FIGS. 7A to 10.

Satisfaction of the above-described conditions by the position detection mark 41 as illustrated in FIGS. 7A and 7B allows the deepest portion 84 having the greatest depth to be positioned in the middle portion 82 and allows the edge portion 83 to have the inclined surface with a depth smaller than that of the deepest portion 84. In other words, it is possible to ensure that the formation is avoided of the local depression PH in the vicinity of both ends as in the case illustrated in FIG. 6A where the linear moving of the spot of the laser is performed only once.

Therefore, the image forming apparatus 1 including the belt 37 provided with the position detection mark 41 is able to prevent in advance the toner to get into the local depression PH. The image forming apparatus 1 described above is also able to prevent in advance the toner from remaining in the local depression PH as a result of insufficient scraping-out by the blade 61 of the cleaning section 16, i.e., occurrence of the passing-through. Accordingly, the image forming apparatus 1 is able to avoid occurrence of registration displacement caused by a shift between the toner images of respective colors as a result of decreased accuracy of detecting the position detection mark 41 by the sensor 18. The image forming apparatus 1 is also able to prevent the end of the sheet of paper P from being damaged or stained as a result of entering of the end of the sheet of paper P into the position detection mark 41. Hence, it is possible for the image forming apparatus 1 to perform a high-quality printing process.

On the basis of the results of the second evaluation test, the position detection mark 41 may have the length L that is equal to or greater than the spot size a of the irradiation light T1, and is also equal to or greater than 5 mm and equal to or smaller than 15 mm, as illustrated in FIGS. 11 and 12. The spot size a may be 2 mm. In other words, the mark effective length La, i.e., the effective length of the effective portion formed in the light reception signal SD as a result of the position detection mark 41, may fall within a range from 4.3 mm to 11.9 mm both inclusive.

This allows, in the image forming apparatus including the belt 37 provided with the position detection mark 41 for clear distinction of the effective length of the effective portion derived from the position detection mark 41 from that derived from other reasons. The effective portion may be formed in the light reception signal SD generated by the sensor 18. The effective portion may have the differential voltage ΔV that is equal to or greater than 1.0 V.

For example, in a case where the controller 4 of the image forming apparatus 1 detects the effective portion in the light reception signal SD supplied from the sensor 18, the controller 4 may be able to determine that the effective portion is derived from the position detection mark 41 when the effective length of the effective portion falls within the range from 4.3 mm to 11.9 mm both inclusive. The controller 4 may be able to determine that the effective portion is derived from another reason when the effective length of the effective portion falls without the foregoing range. Therefore, the image forming apparatus 1 is able to detect the position detection mark 41 with remarkably-high accuracy on the basis of the light reception signal SD generated by the sensor 18. The image forming apparatus 1 is therefore able to control a factor such as the position of the belt 37 or the traveling speed of the belt 37 with high accuracy on the basis of the detection of the position detection mark 41 with remarkably-high accuracy. As a result, it is possible for the image forming apparatus 1 to perform remarkably-high-quality printing process on the sheet of paper P.

It may be a possible option to form the depression grooves of the position detection mark 41 not in the belt traveling direction E but in another direction, for example, the width direction, i.e., the left-right direction. However, in this case, in the image forming apparatus 1 including the belt 37 provided with the position detection mark 41, the blade 61 of the cleaning section 16 repeatedly slides over the ridge formed at the border portion between the adjacent depression grooves when the blade 61 slides against the belt 37. This can put a load on a member, of the image forming apparatus 1, such as the driving roller 31 of the belt device 12. This can also cause vibration or peeling of the blade 61.

Considering the above, the depression grooves of the position detection mark 41 may be formed in the belt traveling direction E. Accordingly, in the image forming apparatus 1, it is possible to slide the blade 61 in the position detection mark 41 smoothly along the depression grooves when the blade 61 of the cleaning section 16 slides against the belt 37. This makes it possible to suppress, for example, a load on a member such as the driving roller 31. This also makes it possible to suppress, for example, generation of vibration of the blade 61.

In some cases where a range of variation in thickness in a single round of the belt 37 of the image forming apparatus 1 is great, the traveling speed of the belt surface 40 may partially vary in accordance with the variation in thickness in the single round of the belt 37. The traveling speed of the belt 37 of the belt device 12 may be higher when the drive force is transmitted from the driving roller 31 to a portion, of the belt 37, having a greater thickness. In contrast, the traveling speed of the belt 37 of the belt device 12 may be lower when the drive force is transmitted from the driving roller 31 to a portion, of the belt 37, having a smaller thickness. In a case where the traveling speed of the belt 37 varies as described above in the image forming apparatus 1, positions of the toner images transferred from the image forming units 11 of the respective colors of the belt 37 may be shifted from each other, resulting in so-called registration displacement.

In order to suppress occurrence of the registration displacement in the image forming apparatus 1, one possible option is to reduce the range of the variation in thickness of the belt 37. However, it is difficult to suppress the range of the variation in thickness, or the range of a level difference, of the belt 37, as the belt 37 may include an elastic material such as polyamide imide resin and be sufficiently thick.

On the basis of the above, in the image forming apparatus 1, a pitch of the position detection marks 41 disposed in the belt traveling direction E may be made coincident with a pitch of the image forming units 11 of the body section 2 illustrated in FIG. 1 that are disposed in the front-rear direction. This makes it possible to suppress occurrence of registration displacement in the image forming apparatus 1 due to the variation in thickness of the belt 37. This also makes it possible to improve accuracy of feedback of the control related to the traveling speed of the belt 37.

According to the above-described configuration, in the image forming apparatus 1, the position detection mark 41 formed on the belt 37 may have the maximum depth Da that is equal to or greater than 2.0 μm and equal to or smaller than 11.0 μm, have the edge depth ratio Db/Da that falls within the range from 0.4 to 0.5 both inclusive, have the edge length ratio Lb/Da that falls within the range from 0.018 to 0.100 both inclusive, and have the length L that is equal to or greater than 5 mm and equal to or smaller than 15 mm. This allows the deepest portion 84 of the position detection mark 41 to be positioned in the middle portion 82 and allows the edge portion 83 of the position detection mark 41 to have an inclined surface having a depth smaller than that of the deepest portion 84. This makes it possible, in the image forming apparatus 1, to avoid formation of the local depression PH. As a result, it is possible for the image forming apparatus 1 to securely scrape the toner out of the position detection mark 41 by the blade 61 of the cleaning section 16, making it possible to detect the position detection mark 41 by the sensor 18 with higher accuracy.

6. Other Example Embodiments

The example embodiments described above have referred to a case where the outer peripheral depth Db of the position detection mark 41 may be the depth, from the belt surface 40, at the position away from the end 81 in a direction toward the middle by 0.2 mm. However, the technology is not limited thereto. In one example embodiment, the outer peripheral depth Db may be the depth at any of the positions away from the end 81 in the direction toward the middle by various distances such as 2.5 mm or 1.8 mm. In other words, it may be sufficient that the outer peripheral depth Db has a value indicating a depth of the edge portion 83.

The example embodiments described above have referred to a case where the non-mark voltage, i.e., the voltage of the portion, of the light reception signal SD generated by the sensor 18, corresponding to the belt surface 40 may be 2.7 V and the reference voltage VS may be 1.7 V which is lower than the non-mark voltage by 1.0 V, as illustrated in FIG. 7. However, the technology is not limited thereto. In one example embodiment, the non-mark voltage may be any one of various voltages such as 3.3 V or 2.5 V. In another example embodiment, the reference voltage VS may be different from the non-mark voltage by any one of various voltages such as 0.8 V or 1.4 V. In a case where the traveling speed of the belt 37 influences the signal level of the light reception signal SD, each of the values of the non-mark voltage and the reference voltage VS may be set on the basis of the traveling speed of the belt 37. In other words, it may be sufficient that the position detection mark 41 is detected with high accuracy on the basis of the effective portion, of the light reception signal SD, having a voltage lower than the reference voltage VS.

The example embodiments described above have referred to a case where, upon formation of each depression groove of the position detection mark 41, the operation of linearly moving the spot of the laser while laser irradiation is performed with relatively low intensity may be performed twice, and each of the irradiation start point and the irradiation end point is made different between the first laser irradiation and the second laser irradiation, as illustrated in FIG. 6. However, the technology is not limited thereto. In one example embodiment, the operation of linearly moving the spot of the laser while laser irradiation is performed with relatively low intensity may be performed once or three or more times. In another example embodiment, the intensity of the laser may be controlled more finely in a region such as the vicinity of the irradiation start point or the vicinity of the irradiation end point. The above-described example embodiments may be adopted in any combination where appropriate. In other words, it may be sufficient that the deepest portion 84 is positioned in the middle portion 82 as a result of preventing the formation of the local depression PH in the edge portion 83 of the position detection mark 41 and providing the edge portion 83 with an inclination that has a depth gradually increasing in the direction from the end 81 toward the middle.

The example embodiments described above have referred to a case where the conditions related to the depth of the position detection mark 41 may be defined as the range of the edge depth ratio Db/Da and the range of the edge length ratio Lb/Da on the basis of the results of the first evaluation test, as illustrated in FIG. 10. However, the technology is not limited thereto. In one example embodiment, a depth at a border between the middle portion 82 and the edge portion 83 may be defined as a border depth De illustrated in FIG. 7. Thereby, the condition related to the depth of the position detection mark 41 may be defined as a range of a border depth ratio De/Da with the use of the border depth De described above.

The example embodiments described above have referred to a case where the condition related to the length L of the position detection mark 41 may be so set on the basis of the results of the second evaluation test that the length L is to be a value other than 3 mm, 4 mm, and 20 mm, as illustrated in FIG. 11. One reason for this is that the mark effective length La may be similar to the effective length of the effective portion derived from the portion, of the belt 37, having the bent characteristics when the length L is any of 3 mm, 4 mm, and 20 mm. However, the technology is not limited thereto. In one example embodiment, in a case where the mark effective length La for the length L having a certain value is similar to the effective length of the effective portion derived from the portion, of the belt 37, having the bent characteristic or any other reason, the L may be set to any value other than the foregoing certain value.

The example embodiments described above have referred to a case where the spot size a of the irradiation light T1 applied by the sensor 18 to the belt 37 may be 2 mm. However, the technology is not limited thereto. In one example embodiment, the spot size a may be any other value such as 1.6 mm or 3 mm.

The example embodiments described above have referred to a case where the nip width N of the blade 61 of the cleaning section 16 may be 0.2 mm. However, the technology is not limited thereto. In another example embodiment, the nip width N may be any other value such as 0.1 mm or 0.3 mm.

The example embodiments described above have referred to a case where the belt 37 may include polyamide imide resin as its material. However, the technology is not limited thereto. In one example embodiment, the belt 37 may include any other resin material having a Young's modulus that is equal to or greater than 2000 Mpa. In another example embodiment, the belt 37 may include any other resin material having a Young's modulus that is equal to or greater than 3000 Mpa. Non-limiting examples of the materials described above may include resins such as polyimide (PI), polyether imide (PEI), polyphenylene sulfide (PPS), polyether ether ketone (PEEK), polyvinylidene fluoride (PVDF), polyamide (PA), polycarbonate (PC), or polybutylene terephthalate (PBT) and a resin-based material including a mixture of any of the above-described resins.

The example embodiments described above have referred to a case where carbon black may be added to the belt 37 as an electrically-charging agent. In one example embodiment, furnace black, channel black, ketjen black, or acetylene black may be added. In one example embodiment, only one of the above-described types of carbon black may be used. In another example embodiment, the above-described types of carbon black may be used in any combination.

The type of the carbon black may be selected appropriately on the basis of desired electric conductivity. For example, it is possible to provide a predetermined resistance to the belt 37 by selecting the type of carbon black such as channel black or furnace black. Further, the carbon black to be used may be decided on the basis of its use. In another example embodiment, carbon black that has been subjected to an antioxidizing-antideteriorating process such as an oxidation process or a grafting process may be used. In one example embodiment, carbon black having increased dispersibility to a solvent may be used. Taking into consideration a factor such as mechanical strength, a content of the carbon black in the belt 37 may fall within a range from 3 wt % to 40 wt % both inclusive relative to a resin solid component in one example embodiment. In another example embodiment, the content of the carbon black may fall within a range from 3 wt % to 30 wt % both inclusive relative to the resin solid component. A method of providing electric conductivity to the belt 37 is not limited to an electronic electrically-conducting method utilizing a material such as the carbon black. In one example embodiment, predetermined electric conductivity may be provided to the belt 37 by adding an ion electrically-conducting agent.

The example embodiments described above have referred to a case where the position detection mark 41 may be formed on the belt 37 of the image forming apparatus 1 using a so-called intermediate transfer method, i.e., a secondary transfer method. The intermediate transfer method may involves transferring of the toner image formed by the image forming unit 11 onto the belt 37 of the belt device 12 and transferring, in turn, the toner image from the belt 37 onto the sheet of paper P. However, the technology is not limited thereto, and the position detection mark 41 may be formed on any other belt. In one example embodiment, the position detection mark 41 may be formed on a conveying belt of an image forming apparatus using a direct transfer method that transfers the toner image formed by the image forming unit 11 onto the sheet of paper P on a conveyance path. The conveying belt of the foregoing image forming apparatus may convey the sheet of paper P along the conveyance path.

The example embodiments described above may have been applied to the image forming apparatus 1 that is a single-function printer. However, the technology is not limited thereto, and one example embodiment of the technology may be applied to any other apparatus. One example embodiment of the technology may be applied to a multi-function printer (MFP) having functions such as a scanner function and a communication function and serving as a copier or a facsimile apparatus. Another example embodiment of the technology may be applied to an apparatus that performs an electrophotographic printing process such as a copier or a facsimile apparatus.

The technology is not limited to the example embodiments and the other example embodiments described above. In other words, the technology encompasses any combination of part or all of the example embodiments and the other example embodiments described above. The technology also encompasses any extracted part of the example embodiments and the other example embodiments described above.

The example embodiments described above have referred to a case where the belt device 12, which may correspond to a "belt device" in one specific but non-limiting embodiment of the technology, includes the belt 37, the position detection mark 41, the driven rollers 32, 33, and 34, and the driving roller 31 which may respectively correspond to a "mark part", a "driven roller", and a "driving roller" in one specific but non-limiting embodiment of the technology. However, the technology is not limited thereto. The belt device may include a belt having any other configuration, a mark part having any other configuration, a driven roller having any other configuration, and a driving roller having any other configuration.

The mark part according to one embodiment of the present disclosure may further include any groove other than the groove such as that illustrated in FIG. 6B or FIG. 7. For example, the mark part according to one embodiment of the present disclosure may further include any groove other than the groove that satisfies the following conditions. The conditions include that the groove extends in the first direction. The conditions include that the groove includes a middle portion and an edge portion. The middle portion is away from a border between the outer peripheral surface and the groove. The edge portion couples the middle portion and the border to each other. The conditions include that the groove has a middle-portion depth that is greater than an edge-portion depth. The middle-portion depth is a depth of the middle portion from the outer peripheral surface. The edge-portion depth is a depth of the edge portion from the outer peripheral surface. The conditions include that the groove has a deepest portion at a position away from the border by 0.2 millimeters or more from the border toward the middle portion. In one example embodiment, however, it may be more favorable that more of the grooves included in the mark part satisfy the foregoing conditions.

INDUSTRIAL APPLICABILITY

One example embodiment of the technology may be utilized in an image forming apparatus that transfers, by an intermediate transfer method, a toner image onto a print medium such as a sheet of paper via a belt.

Furthermore, the technology encompasses any possible combination of some or all of the various embodiments and the modifications described herein and incorporated herein. It is possible to achieve at least the following configurations from the above-described example embodiments of the technology.

(1)

A belt device including:

a belt that is endless and includes an outer peripheral surface, an inner peripheral surface, and a mark part, the outer peripheral surface being flat, the inner peripheral surface being provided opposite to the outer peripheral surface, the mark part being provided on the outer peripheral surface and depressed from the outer peripheral surface toward the inner peripheral surface;

a driving roller that is in contact with the inner peripheral surface, the driving roller causing the belt to travel in a first direction; and a driven roller that is in contact with the inner peripheral surface, the mark part having grooves that extend in the first direction, two or more of the grooves each including a middle portion and an edge portion, the middle portion being away from a border between the outer peripheral surface and corresponding one of the two or more of the grooves, the edge portion coupling the middle portion and the border to each other, the two or more of the grooves each having a middle-portion depth that is greater than an edge-portion depth, the middle-portion depth being a depth of the middle portion from the outer peripheral surface, the edge-portion depth being a depth of the edge portion from the outer peripheral surface, the two or more of the grooves each having a deepest portion at a position away from the border by 0.2 millimeters or more from the border toward the middle portion.

(2)

The belt device according to (1), in which the edge portion of each of the two or more of the grooves of the mark part has an inclined surface, the inclined surface having the edge-portion depth, from the outer peripheral surface, that increases from the border toward the middle portion.

(3)

The belt device according to (1), in which the two or more of the grooves each have an away-position depth that is half or less of a deepest-portion depth, the away-position depth being a depth, from the outer peripheral surface, at a position away from the border by 0.2 millimeters from the border toward the middle portion, the deepest-portion depth being a depth of the deepest portion from the outer peripheral surface.

(4)

The belt device according to (1), in which the two or more of the grooves each have a deepest-portion depth that is equal to or greater than 2 micrometers and equal to or smaller than 11 micrometers, the deepest-portion depth being a depth of the deepest portion from the outer peripheral surface.

(5)

The belt device according to (1), in which the mark part has a mark-part length in the first direction, the mark-part length falling within a range that does not allow for deformation of a region, of the belt, around the mark part resulting from formation of the mark part.

(6)

The belt device according to (5), in which the mark-part length is equal to or greater than 5 millimeters and equal to or smaller than 15 millimeters.

(7)

An image forming apparatus including:

the belt device according to any one of (1) to (6);

an image forming unit that forms a developer image with use of a developer, the image forming unit transferring the developer image onto the belt or a print medium conveyed by the belt; and a sensor that irradiates the outer peripheral surface with irradiation light and detects the mark part on the basis of reflected light, the reflected light being a portion or all, of the irradiation light, that is reflected by the belt and returns to the sensor.

(8)

An image forming apparatus including:

a belt device that causes a belt to travel in a first direction, the belt being endless and including an outer peripheral surface, an inner peripheral surface, and a mark part, the outer peripheral surface being flat, the inner peripheral surface being provided opposite to the outer peripheral surface, the mark part being provided on the outer peripheral surface and depressed from the outer peripheral surface toward the inner peripheral surface, the belt being wound around two or more rollers; and a sensor that irradiates the outer peripheral surface with irradiation light and detects the mark part on the basis of reflected light, the reflected light being a portion or all, of the irradiation light, that is reflected by the belt and returns to the sensor, the mark part having grooves that each extend in the first direction, two or more of the grooves each having a deepest portion in a middle portion, the deepest portion having a deepest depth from the outer peripheral surface, the middle portion being provided at a position away from a border between the outer peripheral surface and corresponding one of the two or more of the grooves, the middle portion being detected by the sensor as the mark part.

(9)

The image forming apparatus according to (8), in which the two or more of the grooves each include the middle portion and an edge portion, the middle portion being away from the border between the outer peripheral surface and the corresponding groove, the edge portion coupling the middle portion and the border to each other, the two or more of the grooves each have a middle-portion depth that is greater than an edge-portion depth, the middle-portion depth being a depth of the middle portion from the outer peripheral surface, the edge-portion depth being a depth of the edge portion from the outer peripheral surface.

(10)

The image forming apparatus according to (8), in which the sensor generates a light reception signal having a signal level based on intensity of the reflected light, and the signal level corresponding to the middle portion is different from the signal level corresponding to the outer peripheral surface by a predetermined threshold or more.

(11)

The image forming apparatus according to (8), in which the middle portion has a middle-portion length in the first direction, the middle-portion length being greater than a diameter of a spot, of the irradiation light, formed on the outer peripheral surface.

(12)

The image forming apparatus according to (8), in which the belt device provides a wound portion to the belt, the wound portion being provided with a wound characteristic by any of the two or more rollers, the sensor detects the wound portion, the middle portion of the mark part has a middle-portion length in the first direction, the wound portion has a wound-portion length, and the middle-portion length is set to be different from the wound-portion length when the middle-portion length is detected by the sensor.

(13)

The image forming apparatus according to (8), further including a cleaning section that includes a blade and scrapes the developer off from the outer peripheral surface traveling in the first direction, the blade being in contact with the outer peripheral surface by a predetermined nip width in the first direction, in which the two or more of the grooves each have an edge-portion length that is equal to or greater than the nip width, the edge-portion length being a length of an edge portion in the first direction, the edge portion being adjacent to the border between the outer peripheral surface and the corresponding groove.

(14)

The image forming apparatus according to (13), in which the two or more of the grooves each have a deepest-portion depth set within a range that allows the blade to scrape out the developer gotten into the corresponding groove, the deepest-portion depth being a depth of the deepest portion from the outer peripheral surface.

(15)

A mark forming method forming a mark part on an outer peripheral surface of a belt, the belt being endless and including the outer peripheral surface and an inner peripheral surface opposite to the outer peripheral surface, the mark part being depressed from the outer peripheral surface toward the inner peripheral surface, the mark forming method including:

irradiating, as first irradiation, a first irradiation region of the outer peripheral surface, the first irradiation region being provided from a first start point to a first end point, the first irradiation region extending substantially parallel to the first direction, the first irradiation region being included in a mark formation region in which the mark part is to be formed; and irradiating, as second irradiation, a second irradiation region of the outer peripheral surface, the second irradiation region being provided from a second start point to a second end point, the second start point being different from the first start point, the second end point being different from the first end point, the second irradiation region extending substantially parallel to the first direction, the second irradiation region being included in the mark formation region and partially overlapped with the first irradiation region, the first irradiation and the second irradiation providing the mark part with a middle-portion depth that is greater than an edge-portion depth, the middle-portion depth being a depth of a middle portion from the outer peripheral surface, the edge-portion depth being a depth of an edge portion from the outer peripheral surface, the middle portion being away from a border between the outer peripheral surface and the mark formation region, the edge portion being adjacent to the border.

In one embodiment of the technology, a deepest portion is positioned in a middle portion of a mark part and an edge portion has a depth smaller than that of the deepest portion. This suppresses the possibility of occurrence of passing-through of a toner when a blade slides to scrape out the toner gotten inside the mark part. Accordingly, it is possible to detect the mark portion with high accuracy without being influenced by the toner in a case where the mark part is detected by a sensor on the basis of light reflected by a surface of a belt.

According to one embodiment of the technology, it is possible to achieve a belt device, an image forming apparatus, and a mark forming method that make it possible to favorably maintain a high-quality printing state.

Although the technology has been described in terms of exemplary embodiments, it is not limited thereto. It should be appreciated that variations may be made in the described embodiments by persons skilled in the art without departing from the scope of the invention as defined by the following claims. The limitations in the claims are to be interpreted broadly based on the language employed in the claims and not limited to examples described in this specification or during the prosecution of the application, and the examples are to be construed as non-exclusive. For example, in this disclosure, the term "preferably", "preferred" or the like is non-exclusive and means "preferably", but not limited to. The use of the terms first, second, etc. do not denote any order or importance, but rather the terms first, second, etc. are used to distinguish one element from another. The term "substantially" and its variations are defined as being largely but not necessarily wholly what is specified as understood by one of ordinary skill in the art. The term "about" or "approximately" as used herein can allow for a degree of variability in a value or range. Moreover, no element or component in this disclosure is intended to be dedicated to the public regardless of whether the element or component is explicitly recited in the following claims.

What is claimed is:

1. A belt device comprising:

a belt that is endless and includes an outer peripheral surface, an inner peripheral surface, and a mark part, the outer peripheral surface being flat, the inner peripheral surface being provided opposite to the outer peripheral surface, the mark part being provided on the outer peripheral surface;

a driving roller that is in contact with the inner peripheral surface, the driving roller causing the belt to travel in a first direction; and a driven roller that is in contact with the inner peripheral surface, the mark part having grooves that extend in the first direction, two or more of the grooves each including a middle portion and an edge portion, the middle portion being away from a border between the outer peripheral surface and corresponding one of the two or more of the grooves, the edge portion coupling the middle portion and the border to each other, the two or more of the grooves each having a middle-portion depth that is greater than an edge-portion depth, the middle-portion depth being a depth of the middle portion from the outer peripheral surface, the edge-portion depth being a depth of the edge portion from the outer peripheral surface, the two or more of the grooves each having a deepest portion at a position away from the border by 0.2 millimeters or more from the border toward the middle portion.

2. The belt device according to claim 1, wherein the edge portion of each of the two or more of the grooves of the mark part has an inclined surface, the inclined surface having the edge-portion depth, from the outer peripheral surface, that increases from the border toward the middle portion.

3. The belt device according to claim 1, wherein the two or more of the grooves each have an away-position depth that is half or less of a deepest-portion depth, the away-position depth being a depth, from the outer peripheral surface, at a position away from the border by 0.2 millimeters from the border toward the middle portion, the deepest-portion depth being a depth of the deepest portion from the outer peripheral surface.

4. The belt device according to claim 1, wherein the two or more of the grooves each have a deepest-portion depth that is equal to or greater than 2 micrometers and equal to or smaller than 11 micrometers, the deepest-portion depth being a depth of the deepest portion from the outer peripheral surface.

5. The belt device according to claim 1, wherein the mark part has a mark-part length in the first direction, the mark-part length falling within a range that does not allow for deformation of a region, of the belt, around the mark part resulting from formation of the mark part.

6. The belt device according to claim 5, wherein the mark-part length is equal to or greater than 5 millimeters and equal to or smaller than 15 millimeters.

7. An image forming apparatus comprising:

the belt device according to claim 1;

an image forming unit that forms a developer image with use of a developer, the image forming unit transferring the developer image onto the belt or a print medium conveyed by the belt; and a sensor that irradiates the outer peripheral surface with irradiation light and detects the mark part on a basis of reflected light, the reflected light being a portion or all, of the irradiation light, that is reflected by the belt and returns to the sensor.

8. The belt device according to claim 1, wherein the deepest portion is provided on the belt upon formation of the two or more of the grooves.

9. The belt device according to claim 8, wherein the two or more of the grooves are provided through first laser irradiation and second laser irradiation, the first laser irradiation being performed in a first irradiation region of the outer peripheral surface, the second laser irradiation being performed in a second irradiation region of the outer peripheral surface, the second irradiation region being partially overlapped with the first irradiation region, and the deepest portion is provided in the second irradiation region.

10. The belt device according to claim 1, wherein the following expression (1) is satisfied:

$$Db/Da \leq 0.5 \quad (1)$$

where Db is a depth of the position away from the border by 0.2 millimeters from the border toward the middle portion of corresponding one of the two or more of the grooves, and Da is a depth of the deepest portion of the corresponding one of the two or more of the grooves.

11. The belt device according to claim 10, wherein the following expression (2) is satisfied:

$$0.4 \leq Db/Da \quad (2)$$

where Db is the depth of the position away from the border by 0.2 millimeters from the border toward the middle portion of the corresponding one of the two or more of the grooves, and Da is the depth of the deepest portion of the corresponding one of the two or more of the grooves.

12. The belt device according to claim 1, wherein a depth of the position away from the border by 0.2 millimeters from the border toward the middle portion of corresponding one of the two or more of the grooves is in a range from 0.8 millimeters to 5.55 millimeters, and a depth of the deepest portion of the corresponding one of the two or more of the grooves is in a range from 2.0 millimeters to 11.0 millimeters.

13. The belt device according to claim 1, wherein the following expression (3) is satisfied:

$$0.018 \leq Lb/Da \leq 0.100 \quad (3)$$

where Lb is a length in the first direction of the edge portion, and Da is a depth of the deepest portion of the corresponding one of the two or more of the grooves.

14. A mark forming method forming a mark part on an outer peripheral surface of a belt, the belt being endless and including the outer peripheral surface and an inner peripheral surface opposite to the outer peripheral surface, the mark forming method comprising:

irradiating, as first irradiation, a first irradiation region of the outer peripheral surface, the first irradiation region being provided from a first start point to a first end point, the first irradiation region extending substantially parallel to the first direction, the first irradiation region being included in a mark formation region in which the mark part is to be formed; and irradiating, as second irradiation, a second irradiation region of the outer peripheral surface, the second irradiation region being provided from a second start point to a second end point, the second start point being different from the first start point, the second end point being different from the first end point, the second irradiation region extending substantially parallel to the first direction, the second irradiation region being included in the mark formation region and partially overlapped with the first irradiation region, the first irradiation and the second irradiation providing the mark part with a middle-portion depth that is greater than an edge-portion depth, the middle-portion depth being a depth of a middle portion from the outer peripheral surface, the edge-portion depth being a depth of an edge portion from the outer peripheral surface, the middle portion being away from a border between the outer peripheral surface and the mark formation region, the edge portion being adjacent to the border.

* * * * *